US005787814A

United States Patent [19]

Lopez Gomez et al.

[11] Patent Number: 5,787,814

[45] Date of Patent: Aug. 4, 1998

[54] RAILWAY AXLE ASSEMBLY FURNISHED WITH AUTOMATIC CHANGE OF TRACK GAUGE AND ADAPTABLE TO CONVENTIONAL FREIGHT BOGIES

[75] Inventors: Jose Luis Lopez Gomez; Luis Archilla Aldeanueva; Julio Frutos Aguado, all of Madrid, Spain

[73] Assignee: Patentes Talgo, S.A., Madrid, Spain

[21] Appl. No.: 812,067

[22] Filed: Feb. 21, 1997

[30] Foreign Application Priority Data

Apr. 17, 1996 [ES] Spain ..... 9600861

[51] Int. Cl.[6] ..... B61F 7/00

[52] U.S. Cl. ..... 105/178

[58] Field of Search ..... 105/178, 218.1; 104/33; 295/36.1

[56] References Cited

U.S. PATENT DOCUMENTS

| | | | |
|---|---|---|---|
| 123,919 | 2/1872 | Lobdell | 105/178 |
| 1,315,672 | 9/1919 | Kleinschmidt | 105/178 |
| 2,056,100 | 9/1936 | Hahn et al. | 105/178 |
| 3,334,596 | 8/1967 | Suri | 105/178 |
| 3,403,637 | 10/1968 | Lich | 105/178 |
| 3,793,966 | 2/1974 | Swoager | 105/178 |
| 3,808,693 | 5/1974 | Plaser et al. | 105/178 |
| 5,471,933 | 12/1995 | Yoshino et al. | 105/178 |

FOREIGN PATENT DOCUMENTS

| | | | |
|---|---|---|---|
| 846859 | 8/1952 | German Dem. Rep. | 105/178 |
| 1455102 | 4/1969 | German Dem. Rep. | 105/178 |
| 1816296 | 10/1969 | German Dem. Rep. | 105/178 |
| 332453 | 10/1966 | Spain . | |

*Primary Examiner*—Mark Tuan Le
*Attorney, Agent, or Firm*—Ladas & Parry

[57] ABSTRACT

Railway axle assembly furnished with automatic change of track gauge and adaptable to conventional freight bogies. It comprises two independent rolling element assemblies (2), each composed of a wheel, a semiaxle, an outer bearing and an inner bearing, the inner bearing carrying a locking catch with two vertical shafts connected together by a bridge which contains the pieces which facilitate its unlocking and subsequent locking. It also includes an axle frame (1) on which are mounted the rolling elements (2) and their locking systems, a device (3) for connecting between the rolling elements, two trusses (4) for translating the brake shoes, a system of electrical continuity between wheels and a device (6) for detecting hot inner bearings. The invention is useful for converting current bogies with fixed axles into bogies with transversely displaceable axles.

18 Claims, 21 Drawing Sheets

RAILWAY AXLE ASSEMBLY FURNISHED WITH AUTOMATIC CHANGE OF TRACK GAUGE AND ADAPTABLE TO CONVENTIONAL FREIGHT BOGIES

FIELD OF THE INVENTION

The present invention relates to a railway axle assembly furnished with an automatic track gauge change system adapted to be incorporated into conventional freight bogies in substitution for their fixed-gauge mounted axles, this axle assembly comprising two independent rolling element assemblies each composed of a monobloc-type wheel with semiaxle and outer and inner bearings, of which the inner bearing carries a locking system consisting of a locking catch which has two vertical shafts of rectangular section which are connected together by a connecting bridge wherein are located the pieces which facilitate its unlocking and subsequent locking.

PRIOR ART

During the seventies, PATENTES TALGO, S. A. developed an automatic track gauge change system adapted to the rolling units of its trains, which allowed fluent railway transfer between networks with tracks of different gauge (RENFE, 1668 mm and UIC, 1435 mm). PATENTES TALGO's solution for tailoring its trains to different track gauges is described in several of its patents, including patent ES-A-332,453 and its counterpart FR-A-1,558,329. These patents required the construction of bogies designed specifically to accommodate their track gauge change system. Therefore it was not possible to incorporate this system into already existing conventional bogies.

SUMMARY OF THE INVENTION

The applicant has now developed a new axle assembly, furnished with the PATENTES TALGO automatic track gauge change system, which can be incorporated into the conventional freight bogies in substitution for the fixed-gauge mounted axles, while requiring almost no additional modification. It will be possible to incorporate this system into bogies currently in service and, in the short term and at a low investment cost, this system will provide for a fleet of wagons suitable for servicing lines with tracks of different gauge, for example, RENFE/UIC gauge (1668/1435 mm) and RUSO/UIC gauge (1520/1435 mm).

The axle assembly developed by the applicant (which in this document is presented applied to a type Y-21 bogie, the model normally used in RENFE's wagons and platforms, but which could equally be applied to a Y-25 UIC gauge bogie) employs two independent rolling element assemblies (wheel with short axle or semiaxle and two bearings), the change of gauge between wheels being effected by simultaneous transverse displacement of the two rolling elements. The design and operating philosophy of the system is identical to that of the current TALGO trains in service.

The single-axle rolling units of TALGO carriages are furnished with locking devices in the two bearings of each rolling element, of which one locking device is normally active whilst the other remains as safety. By contrast, the new axle assembly developed by the applicant incorporates the locking system only in the inner bearing of the rolling elements, allowing the operation and safety of the proposed solution to be fully guaranteed through the great experience already possessed with the TALGO gauge change system. This solution facilitates the complete interchangeability of the new axle assembly with the fixed-gauge axle mounted on the current bogies and prevents unnecessary costs being incurred.

The new axle assembly developed by the applicant in order to achieve the aforesaid objective of incorporating the PATENTES TALGO automatic track gauge change system into the conventional bogies is characterized in that it comprises an axle frame on which are mounted the two rolling element assemblies and their locking systems, a device for connecting between rolling elements, two trusses for translating the brake shoes, a system of electrical continuity between the wheels or an electrical shunting system and a device for detecting hot inner bearings.

According to the invention, the axle frame consists of a metal truss made from welded steel sheets or from cast semiframes welded together, and which rigidly connects together the four cradles for housing the bearings and on which are supported the springs suitable for suspending the bogie by means of corresponding housings, the cradles for housing the outer bearings lodging suitably in the housings of their suspension supports on mounting the axle assembly on the bogie.

For their part, in their outer vertical faces the cradles of the outer bearings incorporate slider plates in order to facilitate the transverse displacement of the rolling element assemblies during the track gauge change operation, whilst the inner faces of said cradles carry inclined planes which act as vertical abutments and on which the bearing is supported and slid transversely during the track gauge change operation. The cradles of the innter bearings have upper and lower abutment and guide pieces for the inner bearing and the locking catch.

In accordance with the invention, said axle frame has outer arms with sliding slippers and centering plates, with which the bogie is supported, slid and guided transversely over a slideway guide of the fixed installation for track gauge change during the track gauge change operation, the slippers having a baseplate and a knuckle joint which transmits the loads to said frame and guarantees good contact with said slideway guide.

Preferably, the baseplate of the slippers and the centering plates are made of plastic.

According to another aspect of the invention, the outer bearing of each rolling element assembly has inclined planes machined in the lower part of its two vertical plane faces, which planes act as vertical abutments and are supported on the corresponding abutments of the outer cradle of said bearing when the wheel is unloaded in the track gauge change operation, the bearing sliding over them on displacing the wheel, while the inner bearing of each rolling element assembly has a lug machined on each of its two vertical plane faces, and which serves for locking and transmission of transverse loads between the rolling element assembly and the axle frame, said lug fitting and being compressed between the upper abutment pieces of the cradle of the inner bearing and the locking catch.

Likewise, the cradle of the inner bearing includes four upper abutment piece assemblies, each of which has an elastic mounting wedge, a vertical surface for lateral abutment and another vertical surface for abutment and guidance of the locking catch, the lug of the inner bearing being heavily compressed in an inclined surface of same by the wedge on the side containing said lug and said compressive force being transmitted to the locking catch through a vertical face of said lug. Said cradle moreover includes four lower abutment piece assemblies which in their upper part have an inclined surface on which a lower face, likewise inclined, of the lug of the inner bearing is supported and slid in the track gauge change operation, each of said assemblies also having a vertical surface for guiding the locking catch.

According to a further aspect of the invention, said device for connecting between the rolling element assemblies comprises two steel bushes each keyed on to the inner end of the semiaxles of the wheels and each furnished with an inner female fluted region of a length somewhat greater than the semidifference between track gauges, there being mounted between the bushes a shaft each of whose ends have heads with male fluting and which are housed in the female fluted regions of the bushes as well as rubber abutments which are lightly compressed against the ends of the semiaxles in the narrow gauge position, there being installed in the end of each bush an abutment hoop formed by two semihoops which retains a rubber abutment on which abuts, the latter being mildly compressed, the head of the shaft in the wide gauge position and which also fastens with the shaft, avoiding the entry of dust or water into the aforesaid flutes.

As an alternative, said device for connecting between the rolling element assemblies comprises two steel bushes each keyed on to the inner end of the semiaxles of the wheels and each furnished with an inner female fluted region of length somewhat greater than the semidifference between track gauges, there being mounted between the bushes a shaft each of whose ends have heads with male fluting and which are housed in the female fluted regions of the bushes as well as rubber abutments which are lightly compressed against the ends of the semiaxles in the narrow gauge position, there being installed in the end of each bush an abutment hoop, formed by two semihoops, by means of another bush threaded externally on to the bush, the hoop having a vulcanized rubber region on which abuts, the latter being mildly compressed, the head of the shaft in the wide gauge position, and the threaded bush carrying retainer rings for fastening with the shaft and with the bush, avoiding the entry of dust or water into the aforesaid flutes.

According to an additional aspect of the invention, said trusses for translating the brake shoes each consist of two arms connected together by a bridge which binds to the outer cover of the inner bearing, there being arranged at the end of each of said arms a fork with sliding inner plates which clasps the corresponding brake shoe support, so that, on displacing the rolling element assemblies together with the trusses in the track gauge change operation, the brake shoes are compelled also to displace to the position corresponding to the new track gauge.

In accordance with the invention, said system of electrical continuity between the wheels consists of braids of superflexible cable which are linked up to the bushes keyed to the ends of the semiaxles and which are housed in the hollow interior of the shaft of the device for connecting between the rolling element assemblies.

Alternatively, said system of electrical continuity between the wheels consists of electrical shunting assemblies which are mounted in the outer covers of the outer bearings and which include collectors, with their corresponding brushes, connected to the metal truss of the axle frame by braids of superflexible cable.

According to a further aspect of the invention, said device for detecting hot inner bearings consists of a mechanical-type detector which comprises an expansion thermostat housed in the end of the semiaxle where the inner bearing is keyed, there being housed in the interior of the semiaxle a rod which has one of its ends almost in contact with the button of the thermostat and which is maintained in its inactive position by means of a spring mounting, the rod carrying at its other end a friction disc gear intended to rub against the outer cover of the outer bearing when the maximum allowable temperature is reached in the region of the inner bearing and the button of the thermostat displaces outwards and pushes the rod, so that said cover of the outer bearing heats up and this heating is detected by the detectors installed in the track.

As an alternative, said device for detecting hot inner bearings consists of a pneumatic-type detector which comprises a thermostat which is mounted in the outer cover of each inner bearing in order to detect its temperature and which, with the reaching of the maximum allowable temperature, actuates a pneumatic valve and produces the emptying of its feed pipe, prompting the vanishing of the control pressure in an emergency valve which opens and causes the discharging of the general brake pipe, as well as maximum braking of the train, this device also carrying a stopcock which makes it possible to restore the brake of the train after actuation of the emergency valve.

According to the invention, the locking catch of the rolling element assemblies will normally have a hollow bridge connecting the vertical shafts and intended to receive the appropriately profiled head of a guide for unlocking the fixed installation for changing track gauge. However, for specific applications, it may be preferable for said bridge to be solid, and thus the invention has developed a new locking catch in which the solid connecting bridge is wider than the base of said vertical shafts and has a cross-section of rectangular form, the upper and lower faces of said connecting bridge being covered with plastic, this bridge being intended to cooperate, in the fixed installation for changing track gauge, with an unlocking guide whose head has a hollow profile adapted to receive said bridge. Furthermore, to each shaft of the catch is welded a platen which can displace upwards and downwards through a slot made in the upper part of the cradle for housing the inner bearing of the rolling element assemblies and which, at its upper end is connected to helical springs which tend to maintain the catch in its locked position.

BRIEF DESCRIPTION OF THE DRAWINGS

The characteristics, aims and advantages of the invention will emerge more clearly through reading the following description in combination with the appended drawings which show.

DETAILED DESCRIPTION OF THE INVENTION

Figure 15:
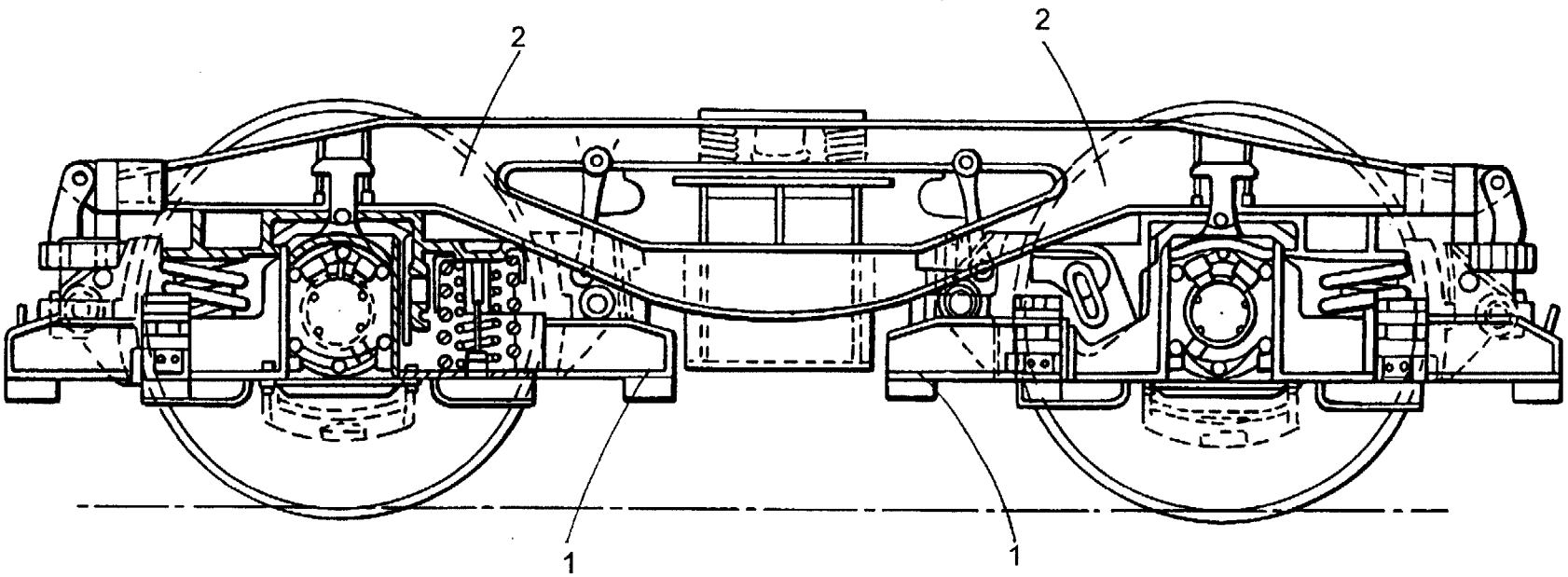
Figure 15A:
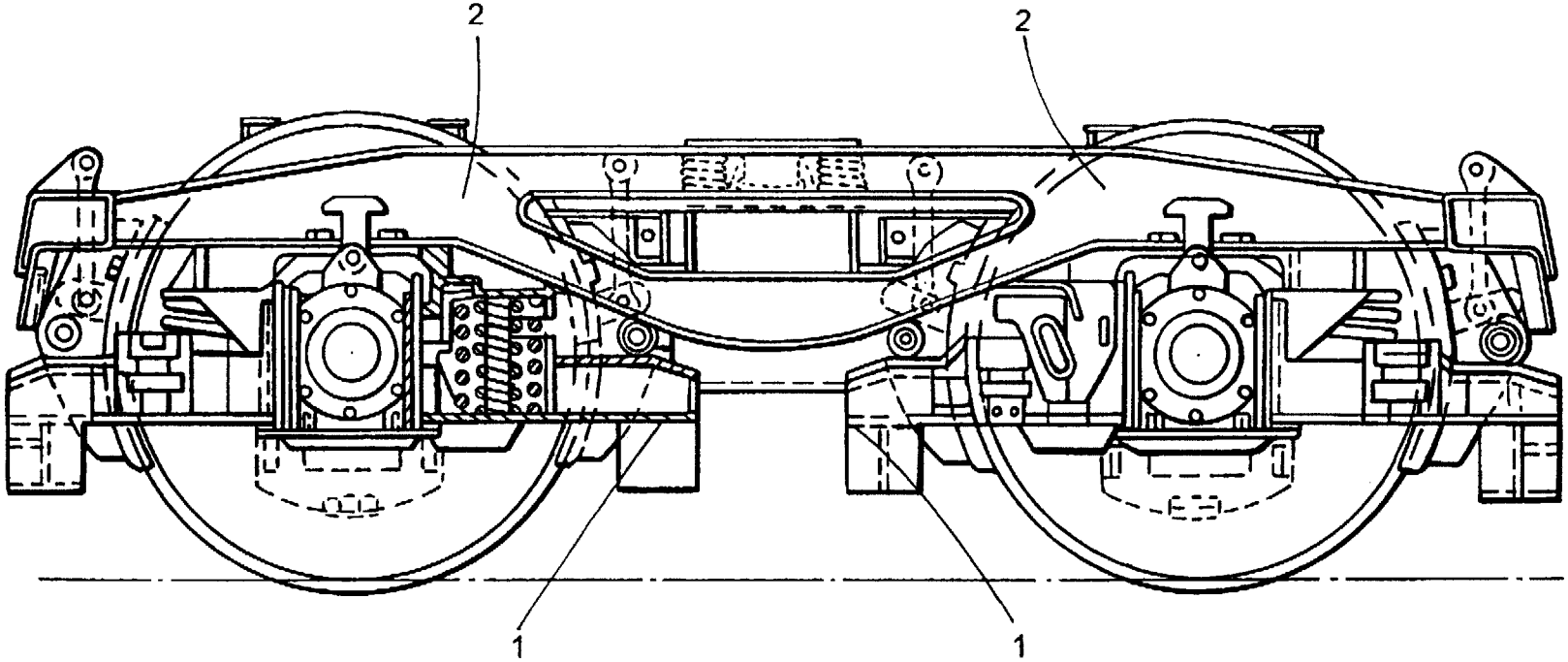

As indicated earlier, this invention contemplates the incorporation of the TALGO track gauge change system into a RENFE Y-21 bogie and into a UIC gauge Y-25 bogie, each of FIGS. 15 and 15*a* representing one of these bogies equipped with the new axle assembly of the present invention designed specifically so as to be able to adapt the bogie to different track gauges. FIG. 15 corresponds to a development of the invention for running on RENFE/UIC gauge tracks (1668/1435 mm), whereas FIG. 15*a* represents a version suitable for running on RUSO/UIC gauge (1520/1435 mm). It would also be possible to realize a version of the axle assembly of the invention which would be suitable so as to be able to run on the three aforesaid track gauges (RENFE/RUSO/UIC).

The increase in weight of the Y-21 and Y-25 bogies on incorporating the TALGO change system of the invention will range between approximately 630 and 830 kg. In the event that there is no requirement to mount a coupling device between rolling elements, this increase in weight will range between approximately 550 and 750 kg.

The new axle assemblies of the invention employ wheels 920 mm in diameter and the maximum allowable load per axle will be the same as employing conventional axles. Furthermore, the new axle assembly incorporates no components requiring greasing.

Figure 1:
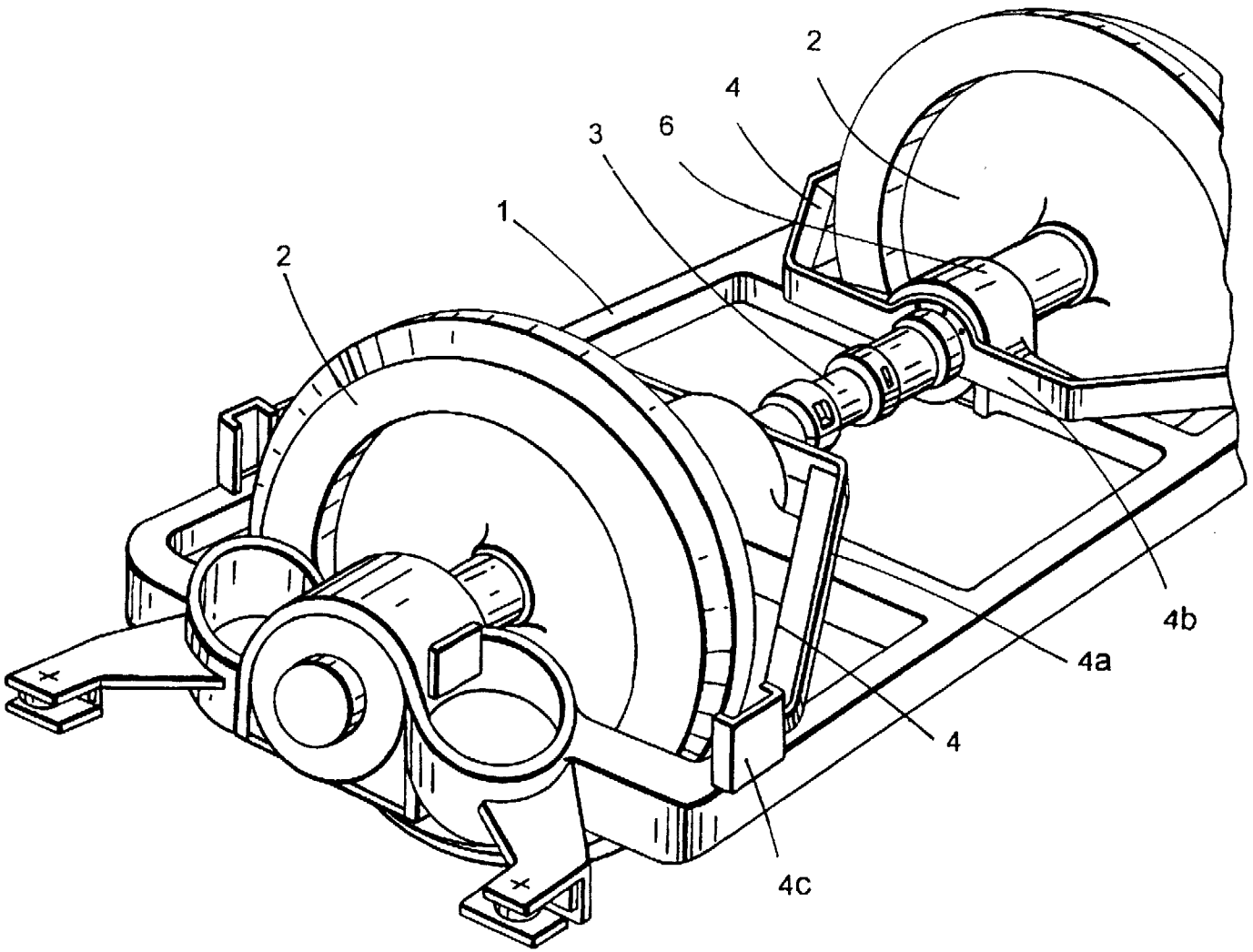
FIGS. 1 and 1*a*, two variants of an axle assembly mounted in accordance with the invention, FIG. 2, an axle frame of the axle assembly according to FIGS. 1 and 1*a*, FIG. 3, a rolling element assembly useable in the invention, FIG. 4, an outer bearing box of the rolling element assembly of FIG. 3, FIG. 5, an inner bearing box of the rolling element assembly of FIG. 3, FIGS. 6 and 6*a*, sections through the outer bearing cradle with lower vertical abutment component, FIG. 7, a section through the inner bearing cradle with components for positioning and securing the bearing box, FIG. 7*a*, a section through the line A—A of FIG. 7 illustrating a detail of the mounting of the retainer of the locking catch of the inner rolling element assembly, FIG. 8, a rolling element assembly useable in the invention together with the cradle for housing its bearings, FIGS. 9 and 9*a*, a perspective and elevational view, respectively, of a locking catch assembly useable in the invention, FIG. 9*b*, a variant of the locking catch assembly useable in the invention, FIG. 10, sectioned view of the sliding and centring slippers in the situation of rest on the sliderail used in the fixed installation for changing track gauge, FIG. 11, a plan view of the fixed installation for changing track gauge useable in the invention, FIG. 11*a*, a sectioned view of the installation for changing track gauge, taken through the line A—A of FIG. 11, FIGS. 12 and 12*a*, two different devices for connecting the rolling element assemblies in accordance with the invention, FIGS. 12*b* and 12*c–d*, two different systems for establishing electrical continuity between the wheels of each rolling element assembly, FIG. 13, a detector of hot inner bearing of mechanical type useable in the invention, FIG. 14, a detector of hot inner bearing of pneumatic type useable in the invention, and FIGS. 15 and 15*a*, Y-21 and Y-25 bogies of displaceable wheels incorporating the automatic track gauge change system of the invention, FIG. 15 corresponding to a bogie for RENFE/UIC gauge and FIG. 15*a* to a bogie for RUSO/UIC gauge.
Figure 1A:
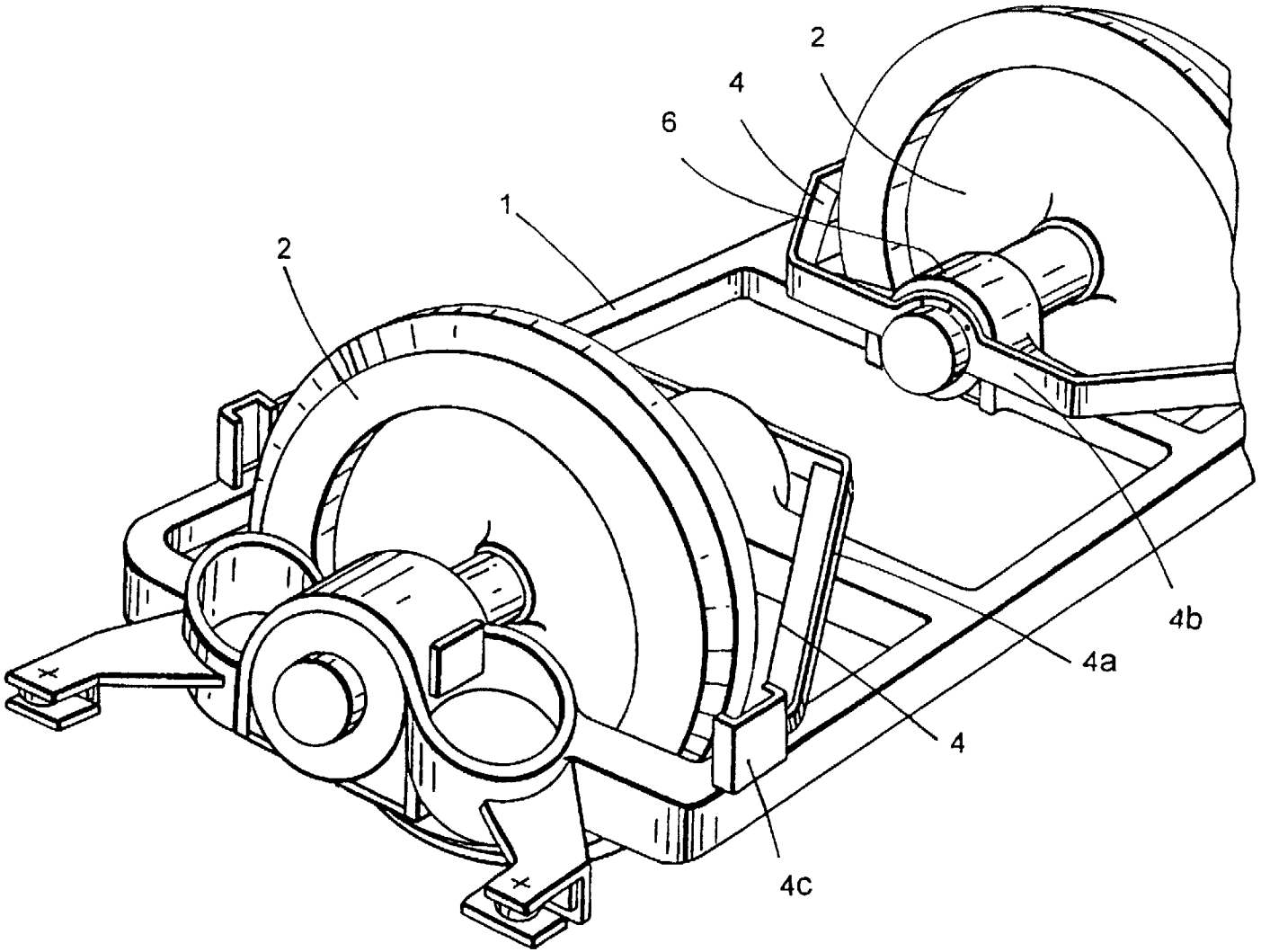
Figure 2:
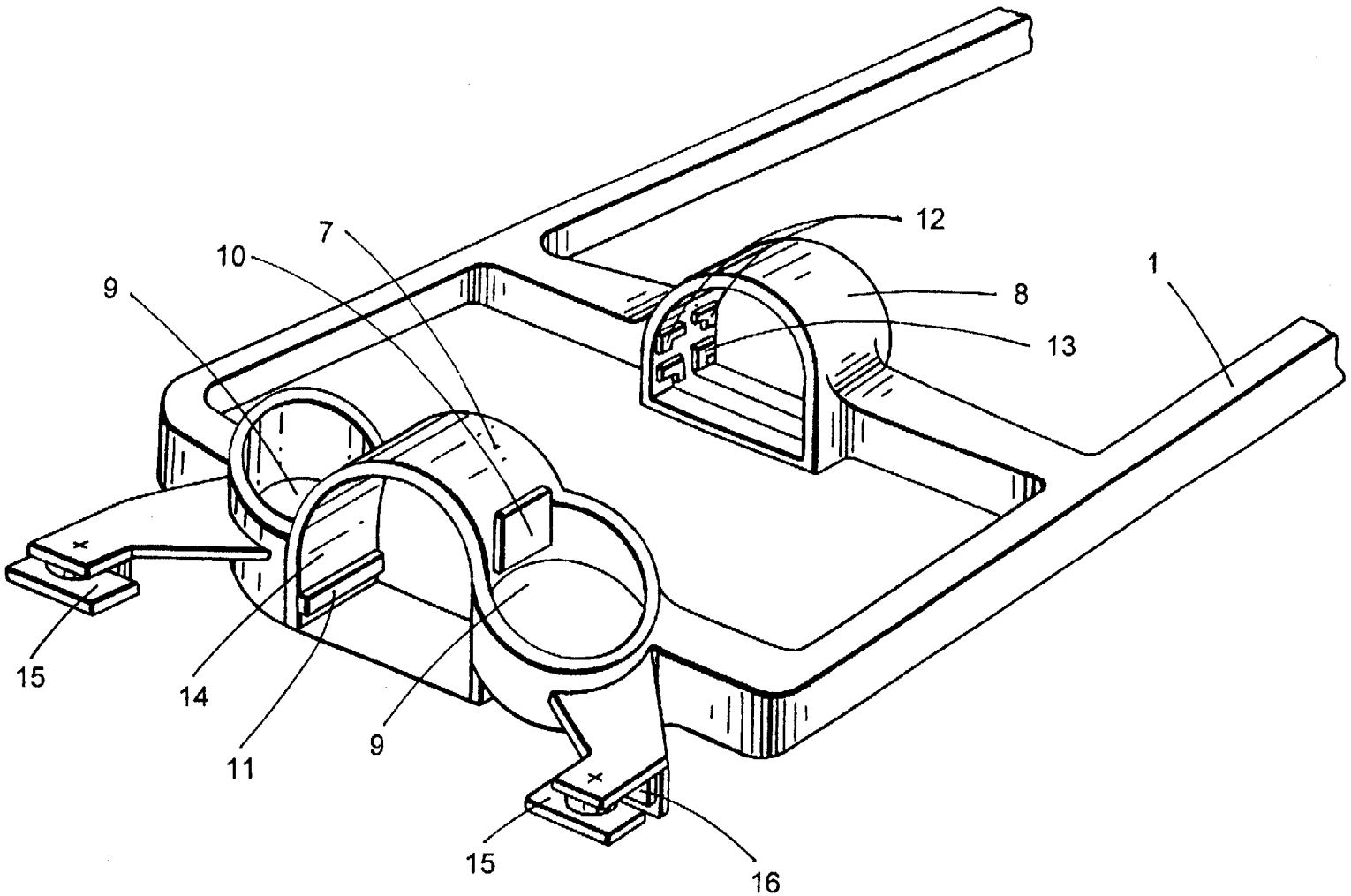

As is apparent in FIGS. 1, 1*a* and 2, the axle assembly of the invention consists of an axle frame 1 on which are mounted two rolling element assemblies 2 and their locking components, a device 3 for connecting the rolling element assemblies 2, two trusses 4 for translating the brake shoes, a system of electrical continuity between the wheels, which can consist of braids of superflexible cable (FIG. 1) or of an electrical shunting system 5 (FIG. 1*a*), and a device 6 for detecting hot inner bearings.

The axle frame 1 consists of a metal truss made from welded steel sheets (or from cast semiframes welded together), and which rigidly connects together the four cradles 7 and 8 for housing the bearings and on which are supported the springs suitable for suspending the bogie by means of corresponding housings 9.

On mounting the axle assembly of the invention on the bogie, the cradles 7 of the outer bearings 19 (FIG. 3) remain suitably lodged in the housings of their suspension supports provided in the bogie. The outer vertical faces of the cradles 7 incorporate slider plates 10. This mounting and the longitudinal and transverse play between the axle assembly and the frame of the bogie are the same as in the case of the mounting of a fixed-gauge axle.

Figure 9:
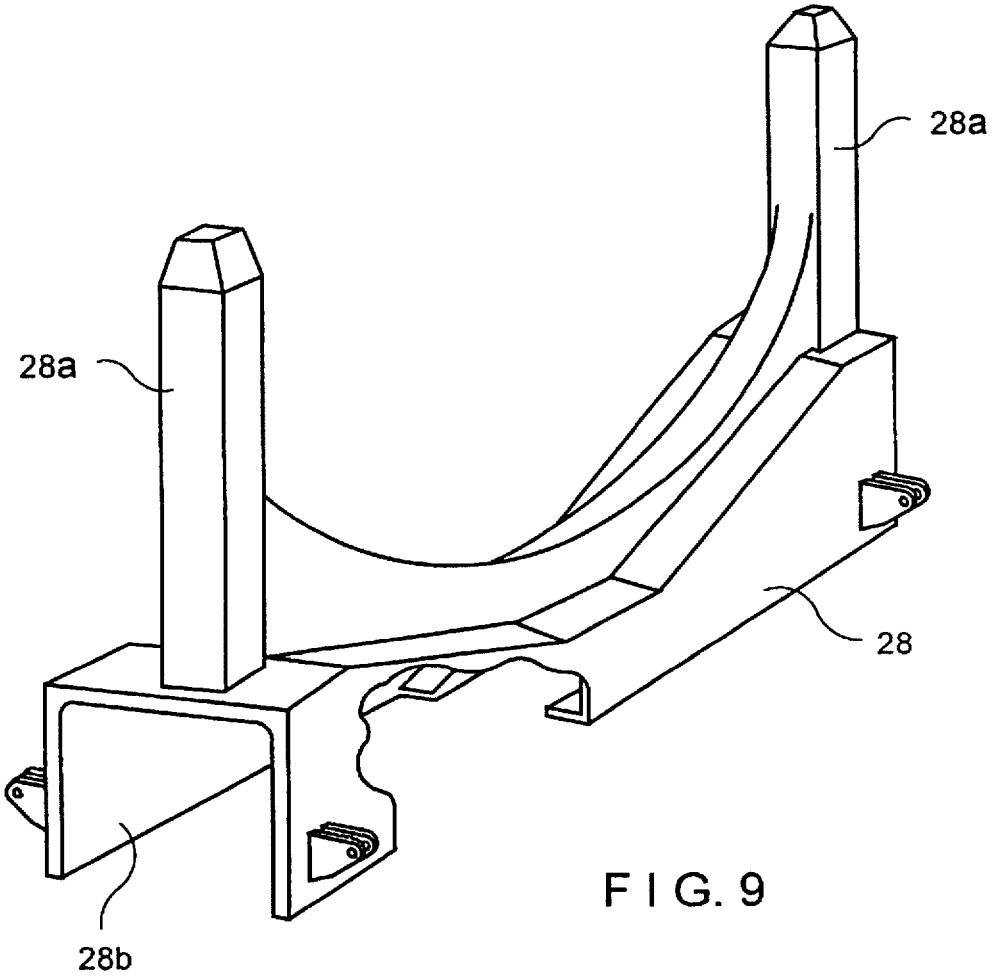

In the inner faces 14 of the cradles 7 of the outer bearings 19 are arranged vertical abutments 11 on which the bearing is supported and slid transversely during the track gauge change operation. For their part, the cradles 8 of the inner bearings 20 (FIG. 3) also incorporate upper 12 and lower 13 abutment and guide pieces for the inner bearing 20 and for the locking catch 28 (FIG. 9).

Figure 10:
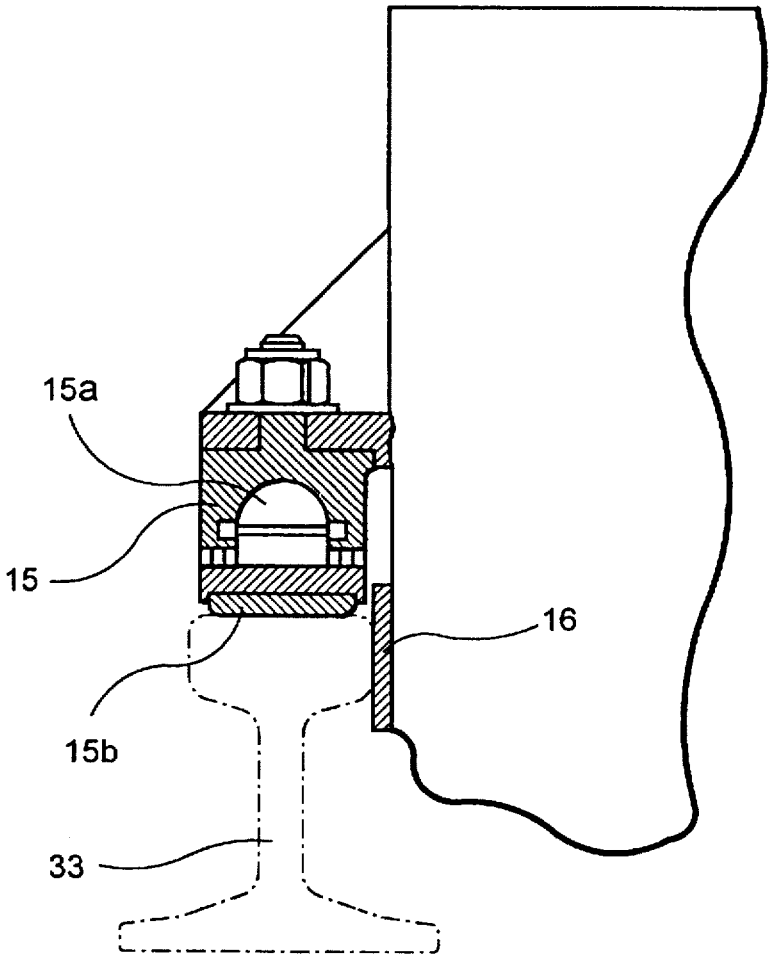

The axle frame 1 carries outer arms on which are installed sliding slippers 15 and centering plates 16. During the track gauge change operation, the bogie is supported, slid and guided transversely on these components, the wheels and the centred axle assembly remaining unloaded. As illustrated in FIG. 10, the sliding slipper 15 transmits the loads to the axle frame 1 via a knuckle joint 15*a* for the purpose of guaranteeing good contact with the slideway guide 33 (FIG. 11) of the fixed installation for changing track gauge. The baseplate 15*b* of the slipper 15 and the centering plate 16 are made of plastic.

Figure 3:
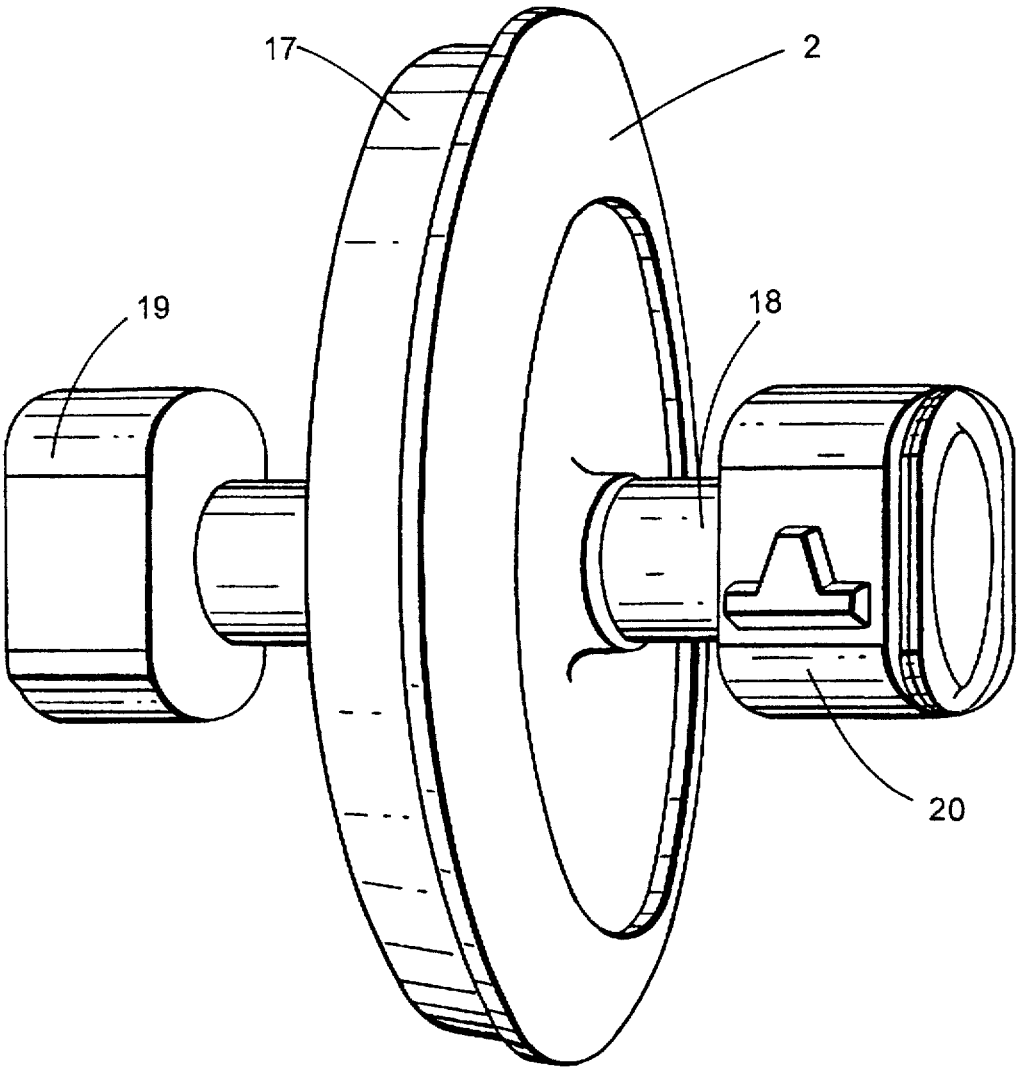

As manifest from FIG. 3, each rolling element assembly 2 consists of a monobloc-type wheel 17 keyed to a semiaxle 18 which incorporates an outer bearing 19 and an inner bearing 20 at its ends.

Figure 4:
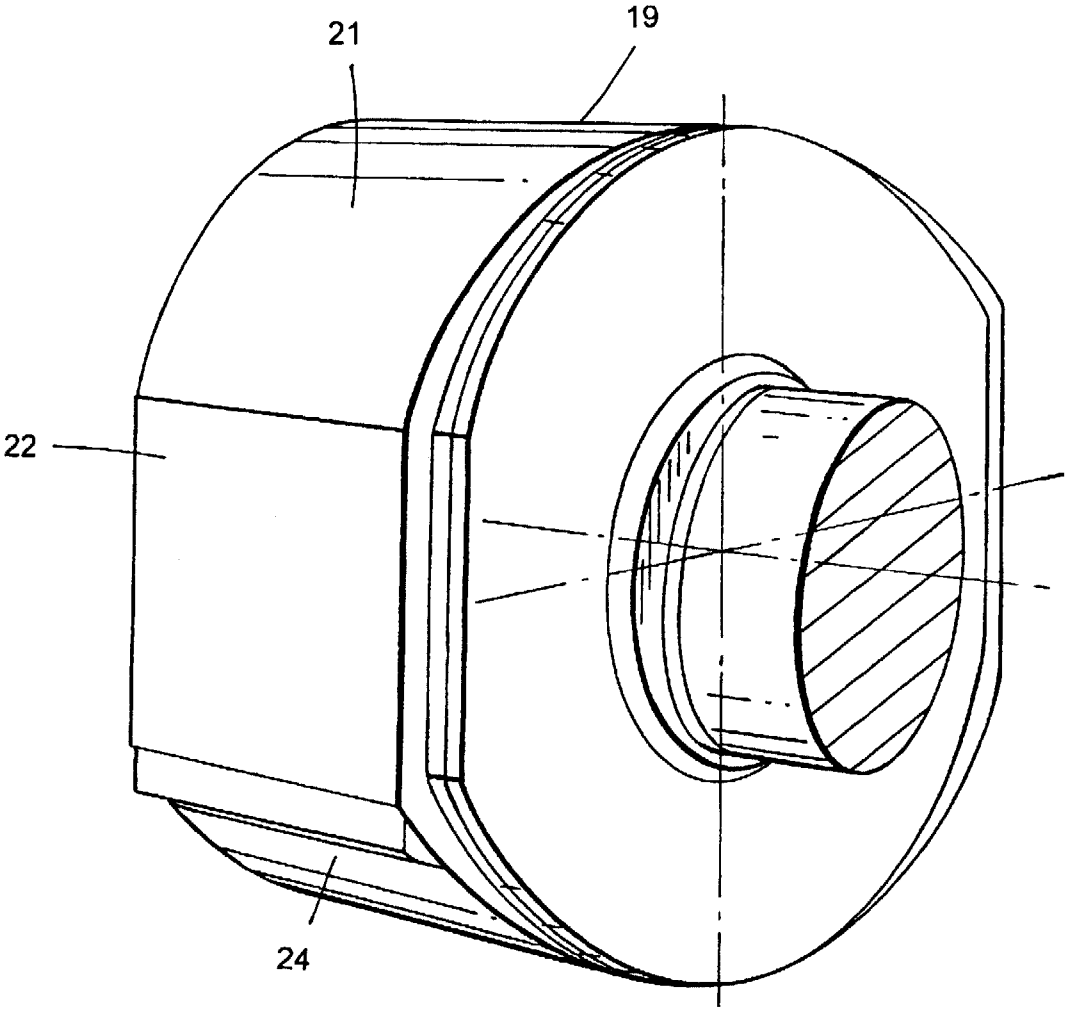
Figure 6:
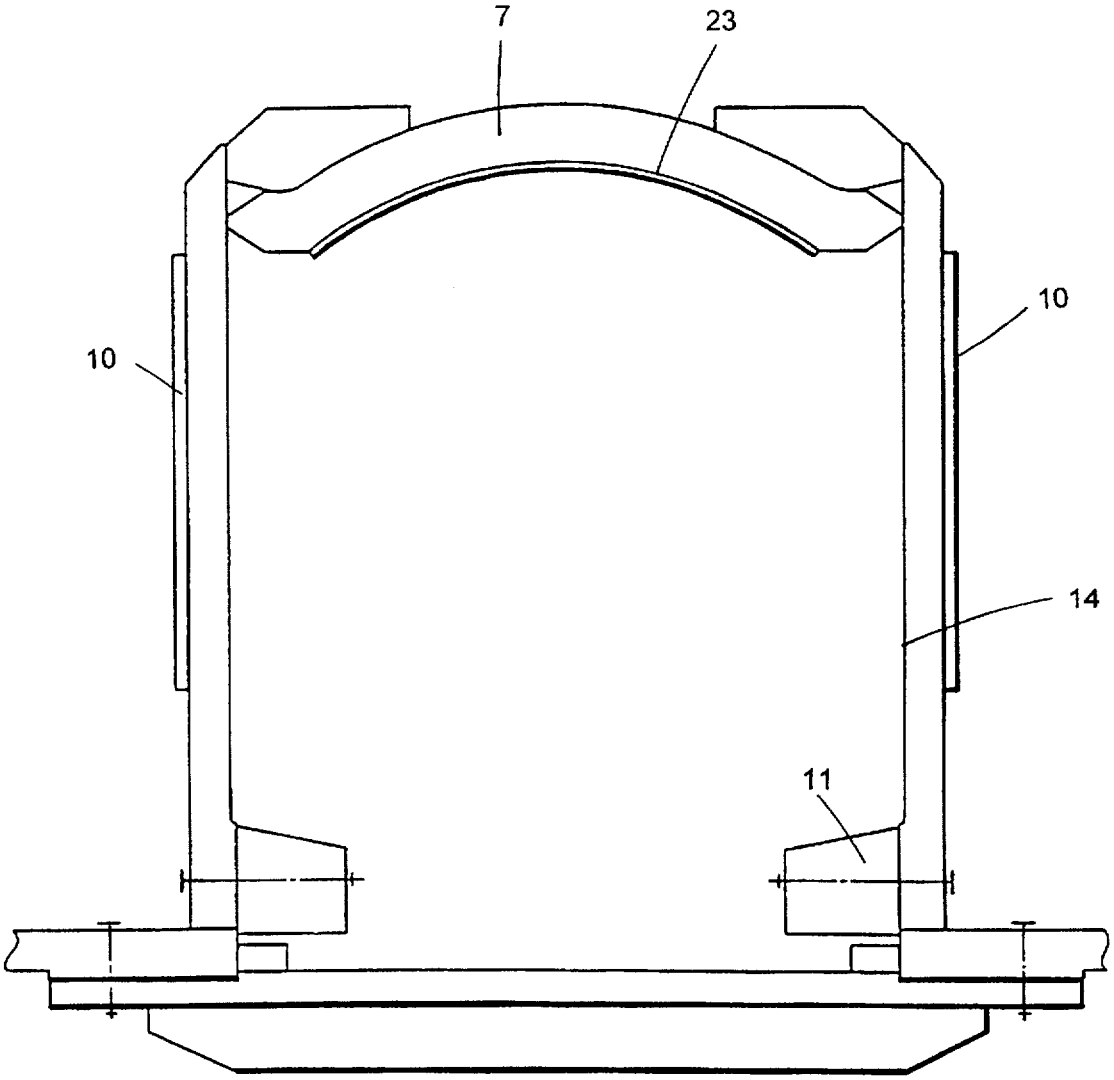
Figure 6A:
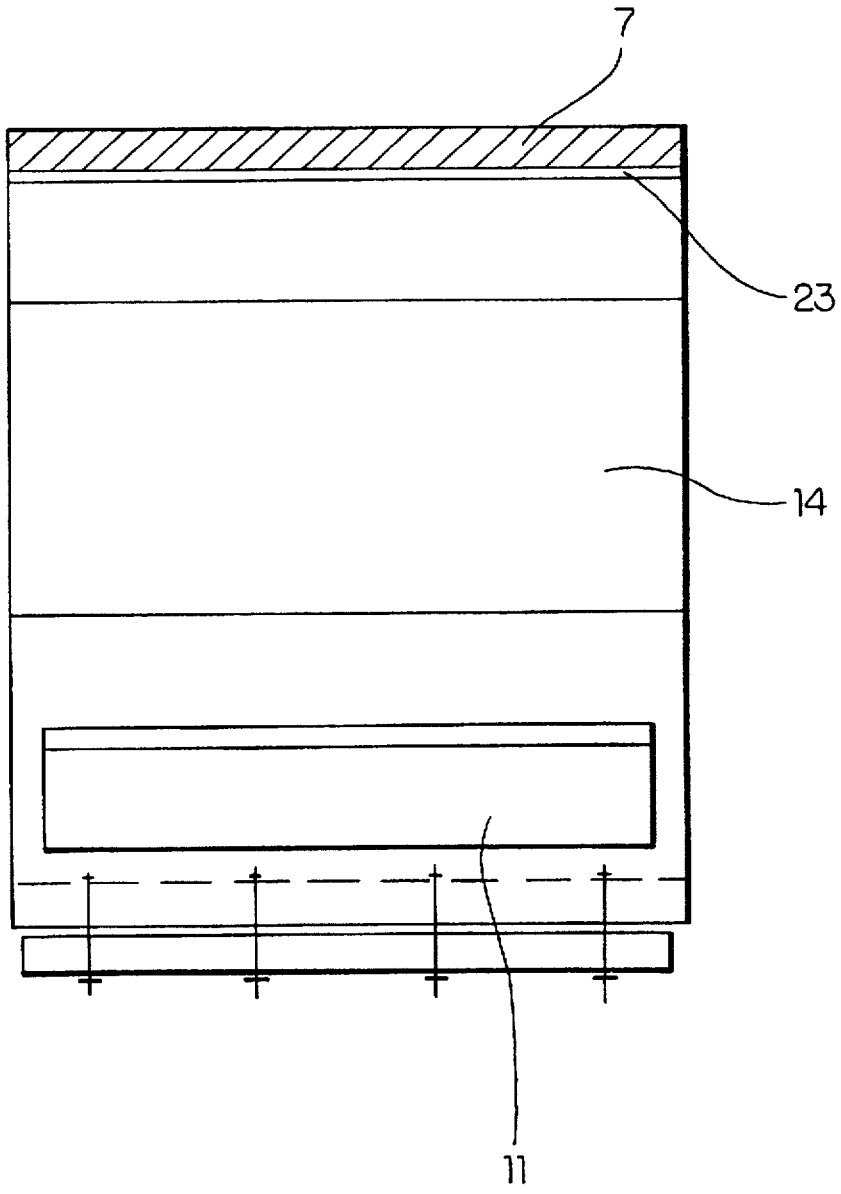

The outer bearing 19 remains lodged in the outer cradle 7 by means of its upper cylindrical surface 21 and its vertical plane faces 22, illustrated in FIG. 4. A plastic ply 23 (FIGS. 6 and 6*a*) is interposed between the upper surface 21 and the cradle 7 so as to distribute the load more uniformly over this surface. The vertical plane faces 22 act as longitudinal abutments against possible revolving of the bearing 19 with respect to the cradle 7. Machined in the lower part of the vertical faces 22 are vertical abutments consisting of inclined planes 24 which are supported on the corresponding abutments 11 of the cradle 7 (which also are inclined planes) when the wheel 17 is unloaded in the track gauge change operation, the bearing 19 sliding over them on displacing the wheel 17. In the normal running situation there is a play of approximately 5 to 7 mm between the inclined plane 24 and the abutments 11 of the cradle 7.

Figure 5:
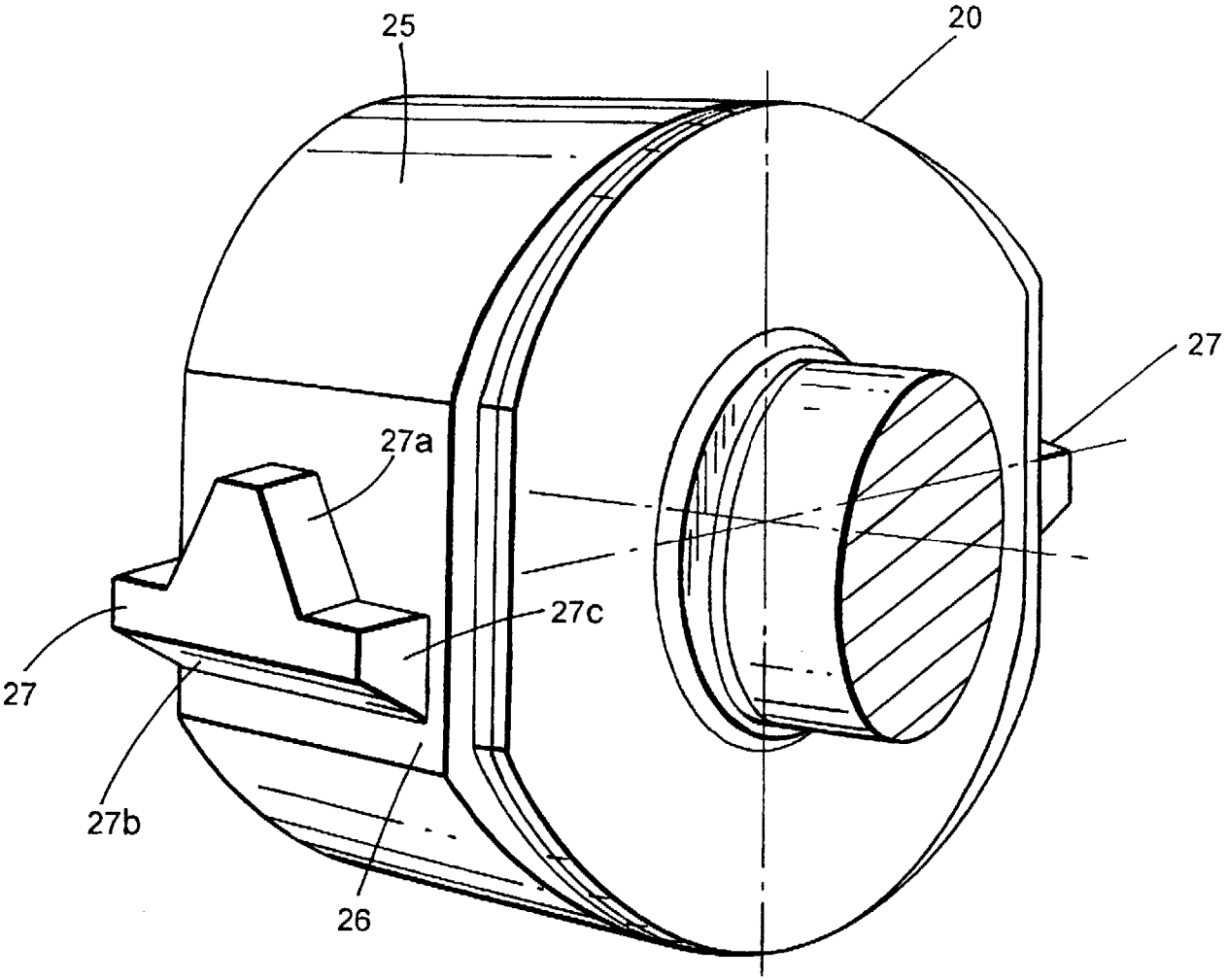

The inner bearing 20 (FIG. 5) is lodged in its cradle 8 by means of its upper cylindrical surface 25 and its vertical plane faces 26 which act as longitudinal abutment against revolving of the bearing 20 with respect to the cradle 8. A plastic ply is also interposed between the upper surface of the bearing and the cradle, like 23 cited earlier, so as to achieve suitable load spreading.

Machined in each of the vertical faces 26 of this bearing 20 is a lug 27 for locking and transmission of transverse loads between the rolling element assembly 2 and the axle frame 1. The lugs 27 fit perfectly and are compressed between the upper abutment pieces 12 integral with the cradle 8 of the bearing 20, as is seen in FIG. 7, and the locking catch 28.

Figure 7A:
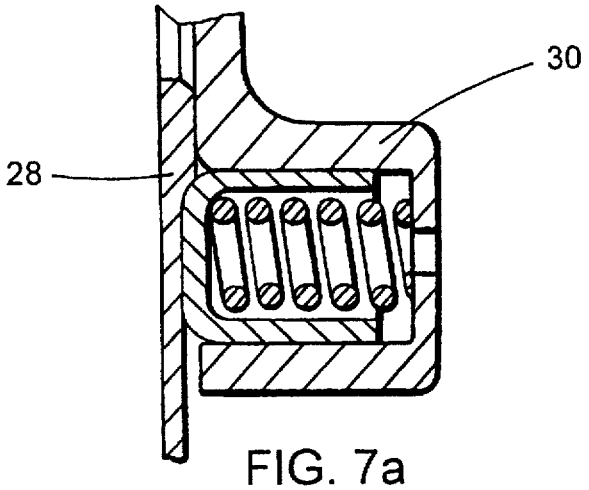
Figure 7:
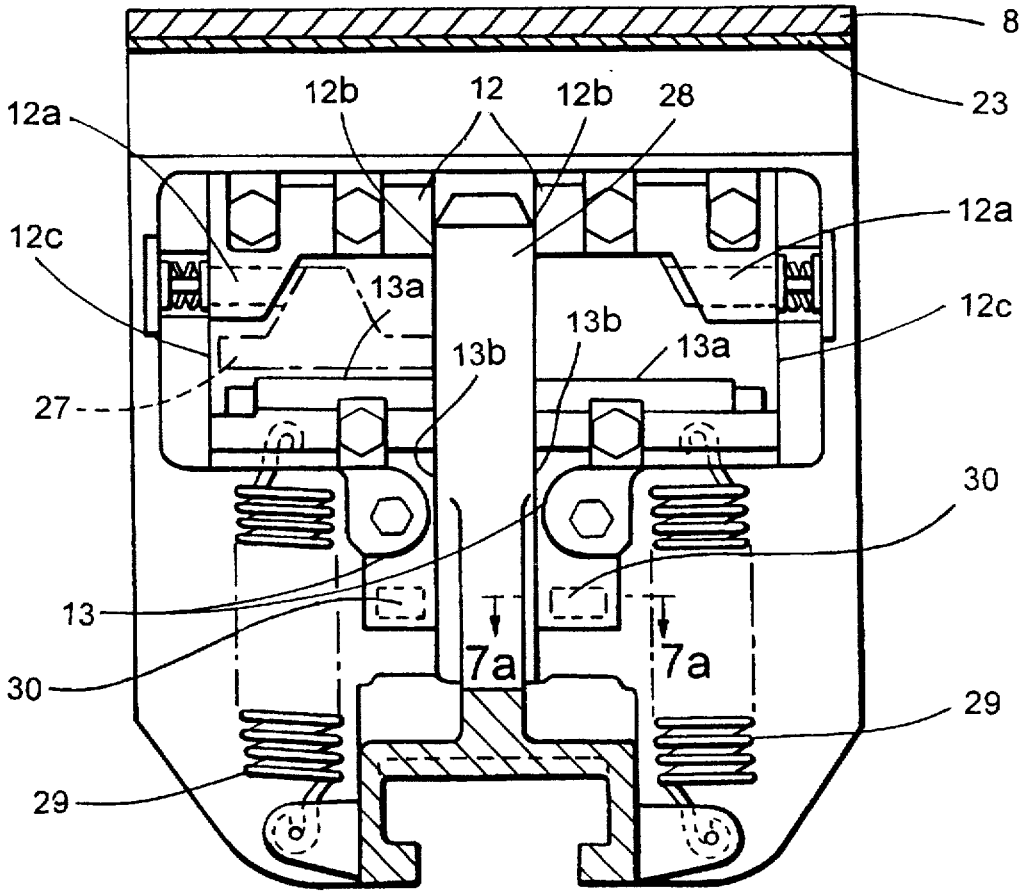

The cradle 8 of the inner bearing 20 employs four upper abutment piece assemblies 12, each of which incorporates a wedge 12*a* with elastic mounting, a vertical surface 12*c* for lateral abutment and another vertical surface 12*b* for abutment and guidance of the locking catch 28 (see FIG. 7). The wedge 12*a* of the side containing the lug 27 of the bearing 20 heavily compresses the former (with a force greater than 3000 daN) through its inclined surface 27*a*. The lug 27 reacts, transmitting this force to the catch 28 through its vertical face 27*c*. The catch 28 remains compressed between the lug 27 of the bearing 20 and the upper and lower abutment pieces of the opposite side with a force which is much greater than the dynamic actions which tend to unlock it.

Figure 8:
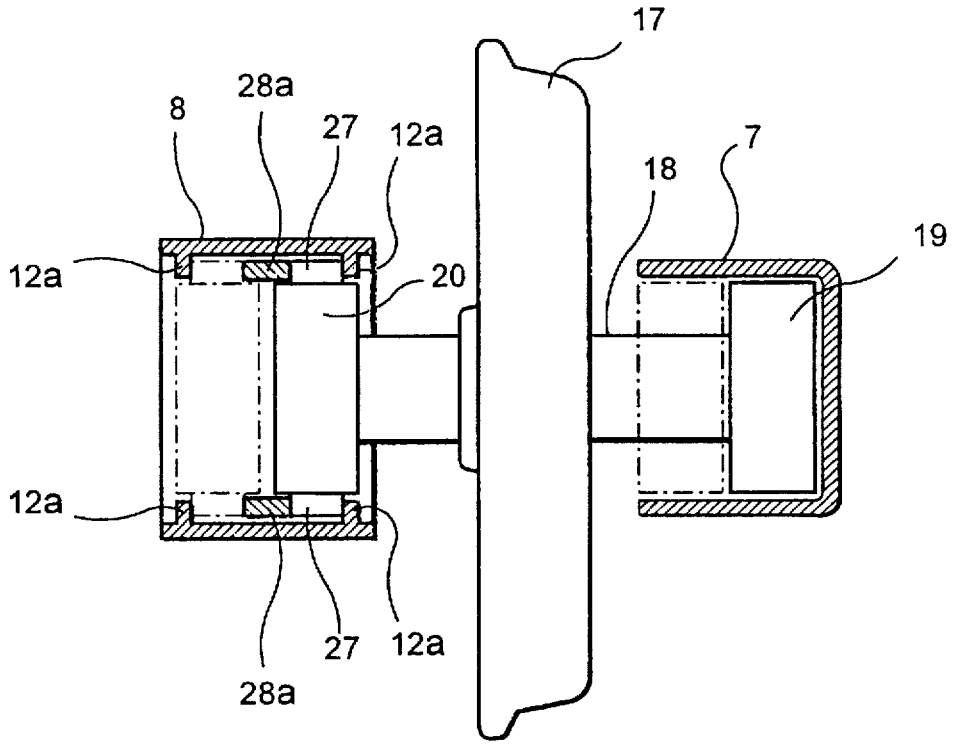

The rolling element assembly 2 remains bound transversely to the axle frame 1 (see FIG. 8) elastically, with a force greater than 7000 daN, which will normally never be exceeded by the dynamic transverse forces exerted on the wheel 17. Should this force be surpassed at an anomalous lateral kink, the wedge 12*a* would be compressed (approximately 1 mm) until the surface 27*c* of the lug abuts with the surface 12*c* of the abutment piece 12. Therefore, while running no relative displacements will occur between the bearing 20, the catch 28 and the abutment pieces 12 of the cradle 8, so that no wear will originate at its contact surfaces.

The cradle 8 incorporates another four lower abutment piece assemblies 13 which in their upper part have an inclined surface 13*a* (see FIG. 7) on which the lower face 27*b*, likewise inclined, of the lug 27 of the bearing 20 is supported and slid during the track gauge change operation. This inclination promotes the centering of the rolling element assembly 2 during track gauge change and prevents the deposition thereon of foreign bodies. With the bearing 20 locked, there is vertical play of approximately 5 to 7 mm between the lug 27 and the surface 13*a* of the lower abutment piece 13. The vertical surface 13*b* of the lower abutment pieces 13 is also a guide for the locking catch 28.

Figure 9A:
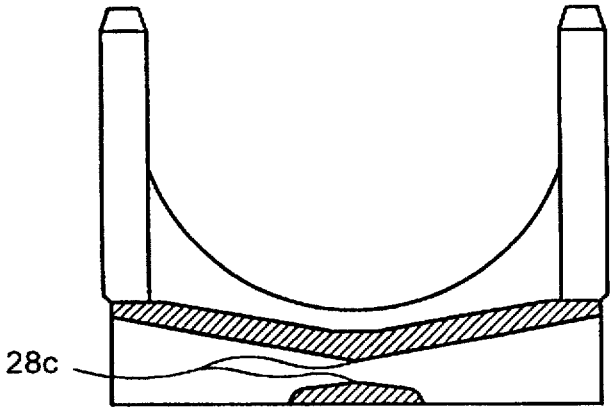

As emerges from FIG. 9 of the drawings, the locking catch 28 consists of two vertical shafts 28*a* of rectangular section, connected together by a hollow bridge 28*b* designed suitably so that the head of the T-shaped unlocking guide 34 (FIG. 11) of the fixed installation for changing track gauge may be inserted therein. The housing for this guide 34 is designed such as to allow variations in the inclination thereof. Contact of the catch 28 with the guide 34 is effected via suitable slider pieces 28*c* (FIG. 9*a*) mounted thereon.

Although the catch 28 is tightly imprisoned between the lug 27 of the bearing 20 and the lateral abutment pieces 12 and 13 of the cradle 8, for safety said catch employs four springs 29 (FIG. 7) pretensioned with a force greater than the vertical dynamic forces and the weight of the catch 28.

Additionally, each shaft 28*a* of the catch 28 is imprisoned by two sprung retainer devices 30 (FIG. 7*a*) which provide additional safety against the possible unlocking of the catch 28. The four retainers 30 are capable of maintaining the catch 28 in the locked position, affording a retaining force greater than the vertical forces tending to cause it to descend.

Figure 9B:
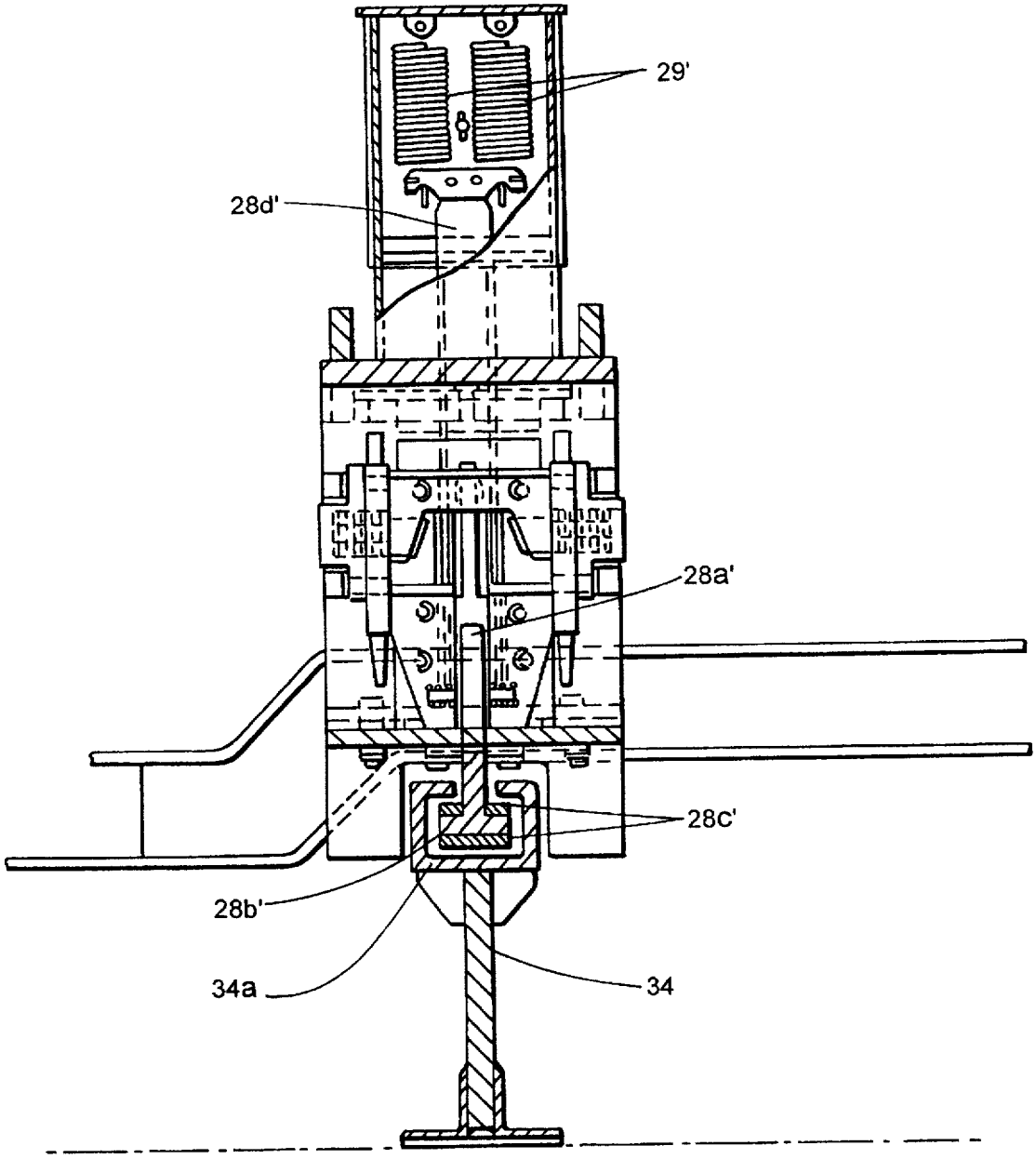

FIG. 9*b* of the drawings shows a variant of the locking catch useable for the invention. In this variant, envisaged for its use in places where owing to their harsh weather conditions during winter the possibility cannot be excluded of the accumulation of snow or ice in the hollow bridge in the catch, the connecting bridge 28*b'* is solid and wider than the base of the vertical shafts of the catch and has a cross-section of rectangular form, the upper and lower faces of said bridge being covered with plastic 28*c'*, thereby facilitating the shedding of the snow or ice which may have accumulated on the bridge owing to the lesser adherence thereof to plastic as compared with its adherence to metal surfaces. This solid bridge is intended to cooperate, in the fixed installation for changing track gauge, with an unlocking guide 34 whose head 34*a* exhibits a hollow profile adapted to receive said bridge 28*b'*.

Additionally, to each shaft 28*a'* of the catch is welded a platen 28*d'* which is displaceable upwards and downwards (dragging the shaft 28*a'* with it) through a slot (not visible in the drawings) made in the upper part of the cradle 8 for housing the inner bearing 20 of each rolling element assembly 2. This platen is connected at its upper end to helical springs 29' which tend to maintain the catch in its locked position. In this variant of the locking catch these springs 29' have been provided in substitution for the springs 29 of the variant of said catch illustrated in FIGS. 9 and 9*a*.

The detector 6 of hot box (FIG. 1) is mounted on the axle of the wheel 17 and in the region of the inner bearing 20, or in the outer cover of this bearing 20. No device of this class is mounted on the outer bearing 19 since the thermal state thereof is perfectly monitored by the detectors installed in the track, both in wide gauge and in narrow gauge.

At the inner end of the rolling element axle assembly of the invention there may be coupled the device 3 for connecting between the two rolling element assemblies 2 of the axle. However, it would be possible to dispense with this device 3 should it be determined through suitable trials that it is not expedient to incorporate it into the bogie or else the latter exhibits better behavior with free wheels.

The function of the device 3 for connecting the rolling element assemblies 2, when it is installed, is to rigidify the two rolling element assemblies 2 of the axle assembly of the invention against relative mutual revolving, but allowing their transverse displacement, required in order to carry out the changing of track gauge. In this way the two rolling element assemblies 2 of the axle are accorded self-guidance provided by the conicity of the wheels 12, just as in the case of a one-piece axle.

In the conventional bogie under consideration, i.e. the RENFE type Y-21 bogie or the UIC gauge Y-25 bogie with no axle steering system, it will be necessary possibly to incorporate the device 3 for connecting rolling elements 2. However, in the case of the TALGO single-axle rolling units, furnished with guiding systems, or in bogies with steerable axles, the connection between the wheels 17 will probably not be required since the linking motion is eliminated and the stability of the bogie or rolling unit is improved on employing free wheels. However, this device 3 will be regarded as being mounted on the new axle assembly in the description of the present invention.

Figure 12:
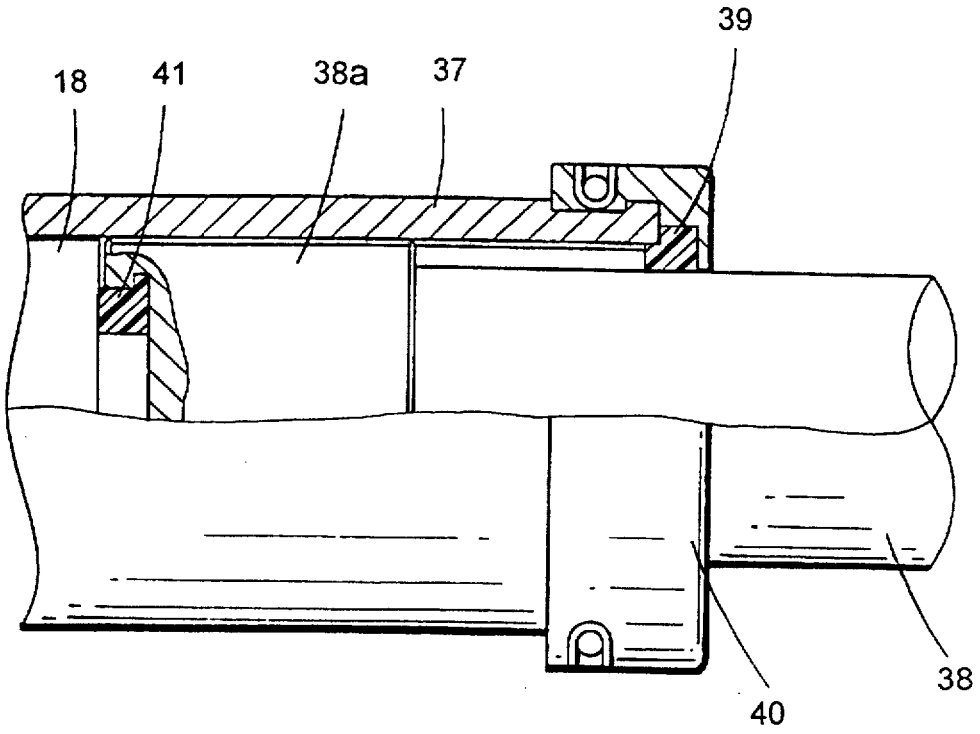

As emerges from FIG. 12, the device 3 for connecting rolling elements 2 consists of two steel bushes 37 each keyed on to the inner end of the semiaxles 18 of the wheels 17. Each bush 37 has an inner female fluted region of length somewhat greater than the semidifference between track gauges.

Between the bushes 37 is mounted a shaft 38 whose ends each have heads 38*a* with male fluting, which heads are housed in the female fluting region of the bushes 37. At both ends of the shaft 38 are mounted rubber abutments 41 which are lightly compressed against the ends of the semiaxles 18 in the narrow gauge position.

Installed at the end of the bush 37 is an abutment hoop 40 formed by two semihoops which retains an elastic abutment 39 on which abuts, the latter being mildly compressed, the head 38*a* of the shaft 38 in the wide gauge position, at the same time as it fastens with the shaft 38 so as to avoid the entry of dust or water into the flutes.

Figure 12A:
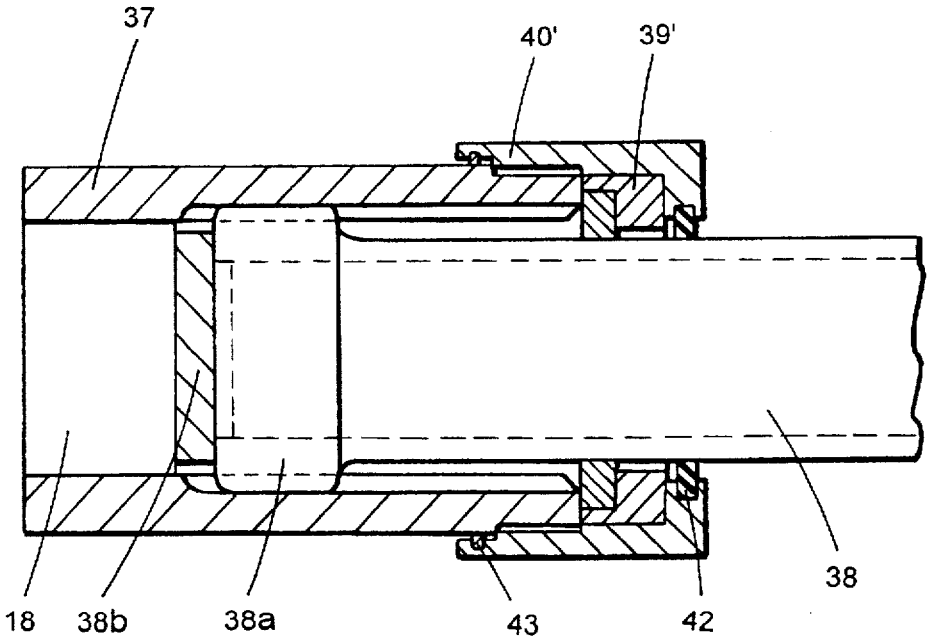

A variant of the device 3 for connecting rolling elements 2 is illustrated in FIG. 12*a* of the drawings, where it is apparent that said device consists of two steel bushes 37, one keyed on to the inner end of the semiaxles 18 of the wheels 17, each bush having an inner female fluted region of length somewhat greater than the semidifference between track gauges.

Between the bushes 37 is arranged a shaft 38 whose ends have heads 38*a* with male fluting and which are housed in the female fluting region of the bushes 37. The ends of the shaft 38 both carry rubber abutments 38*b* which are lightly compressed against the ends of the semiaxles 18 in the narrow gauge position.

Installed at the end of the bush 37 is an abutment hoop 39', formed by two semihoops, by means of another bush 40' threaded externally on to the bush 37. The hoop 39' has a vulcanized rubber region on which abuts, the latter being mildly compressed, the head 38*a* of the shaft 38 in the wide gauge position.

The threaded bush 40' incorporates retainer rings 42 and 43 which fasten with the shaft 38 and with the bush 37, preventing the entry of dust or water into the flutes.

Mounted between the two bushes 37, both in the variant of FIG. 12 and in that of FIG. 12*a*, are braids of flexible cable which guarantee perfect electrical continuity between the two wheels 17 of the axle.

The assembly is designed in both variants in such a way that the shaft 38 transmits neither vertical nor longitudinal load between the rolling elements 2. The slight clearances of the flutes and the dimensioning of the heads 38*a* of the shaft 38 enable the mounting thereof to be able to take up the small misalignments and off-centrings which the axles of the rolling elements 2 may exhibit. Therefore, the shaft 38 transmits only the torques which originate between these rolling elements.

As indicated in FIGS. 1 and 1*a* of the drawings, the axle assembly of the invention incorporates two trusses 4 for translating the brake shoes which each consist of two arms 4*a* connected together by a bridge 4*b* which is bound to the outer cover of the inner bearing 20. Arranged at the end of each arm 4*a* is a fork 4*c* with sliding inner plates and which clasps the corresponding brake shoe support. The shoe holders currently mounted in the bogies will have to be modified so as to furnish them with vertical plates of larger dimensions in the region where they are clasped by the forks 4*c*.

The truss 4 maintains the shoes in a fixed position, and in the track gauge change operation the truss 4 displaces with the rolling element 2 compelling the shoes to translate to the position corresponding to the new track gauge.

The axle assembly of the invention is also equipped with the device 6 for detecting hot inner bearings 20. Below are described two variants of this device which have been regarded as more viable, functionally more reliable and more economical, although other solutions which would make it possible to detect the heating of the inner bearings 20 have been studied.

Figure 13:
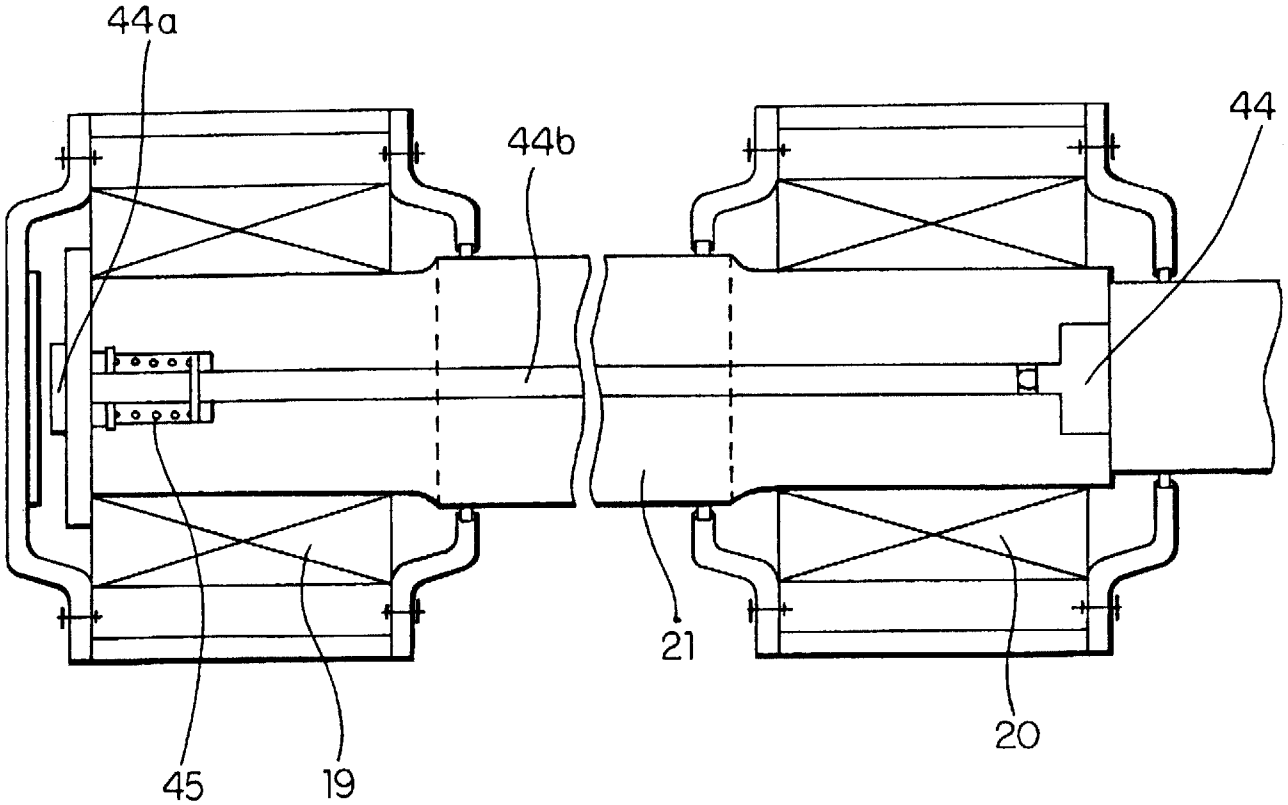

The first variant is illustrated in FIG. 13 and consists of a mechanical-type detector whose operation is based on causing the heating of the outer box 7 when the maximum allowable temperature is exceeded in the inner box 8. The detectors of hot boxes installed in the track will detect the heating caused in the outer box 7.

This device 3 consists of an expansion thermostat 44 housed in the end of the semiaxle 18 where the inner bearing 20 is keyed. Housed in the interior of the semiaxle 18 is a rod 44*b*, one of the ends of which remains almost in contact with the button of the thermostat 44. At its other end this rod carries a friction disc gear 44*a* and is retained by means of a spring mounting 45 in the position drawn in FIG. 13.

When the maximum allowable temperature is reached in the region of the inner bearing 20, the button of the thermostat 44 displaces outwards, pushing the rod 44*b* and compelling its disc 44*a* to rub against the outer cover of the outer bearing 19. The pressure exerted by the shaft of the thermostat 44 is high enough so that at 100 km/h the power generated by this rubbing will be approximately 800 W, this being a value sufficient to cause the heating necessary in the outer cover of this bearing 19 so as to be detected by the detectors installed in the track.

When the inner bearing 20 cools down, the spring 45 causes the rod 44*b* and the shaft of the thermostat 44 to return to their initial position.

This type of thermostat is very reliable. Its shaft has a travel of approximately 5 to 7 mm and the temperature variation between the start and finish of its displacement is only some 5° C. above the set temperature.

Figure 14:
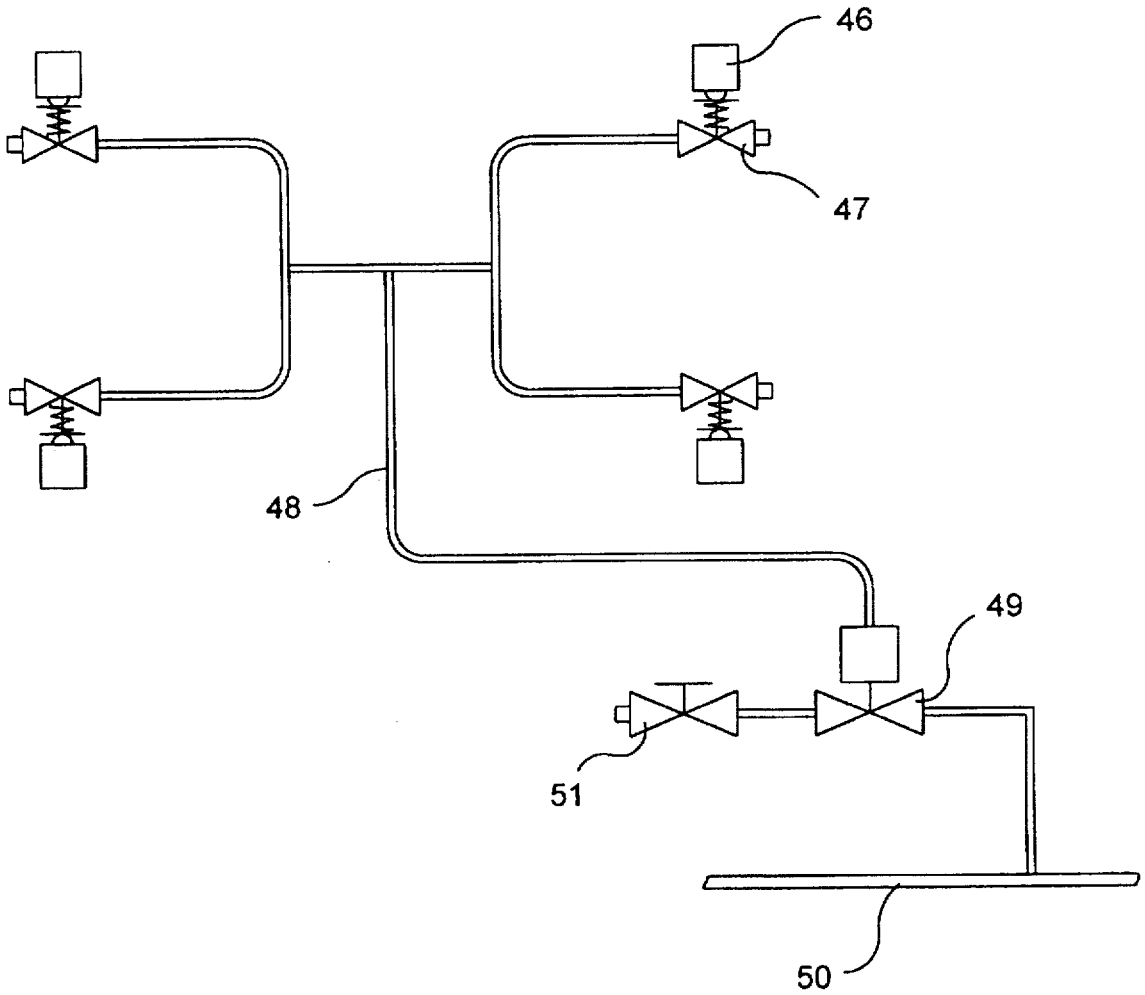

The second variant of the device 6 is illustrated in FIG. 14 and consists of a pneumatic-type detector. Each outer cover of the inner bearings 20 incorporates a thermostat 46 detecting its temperature. This thermostat, similar to that described for the earlier variant, contrives that, with the reaching of the maximum allowable temperature, a pneumatic valve 47 is actuated causing the emptying of its feed pipe 48. When this pipe becomes empty, the control pressure in an emergency valve 49 vanishes and the latter opens and causes the discharging of the general brake pipe 50, thereby producing maximum braking of the train. The installation is entirely similar to that of the emergency cords mounted in railway carriages.

The four thermostats 46 and the four valves 47 corresponding to a bogie have been drawn in FIG. 14. The installation additionally incorporates a stopcock 51 which makes it possible to restore the brake of the train, in the event of actuation of the emergency valve 49, after locating the fault which gave rise to the operating of said valve.

There are other possible devices for detecting hot inner bearings 20, but these are more sophisticated in design and higher in cost.

The monitoring of the temperature of the outer bearings 19 is carried out by means of the detectors installed in the track. With the TALGO track gauge change system, the monitoring of these bearings 19 is fully guaranteed for any track gauge, since they move with the wheels 17.

Figure 12B:
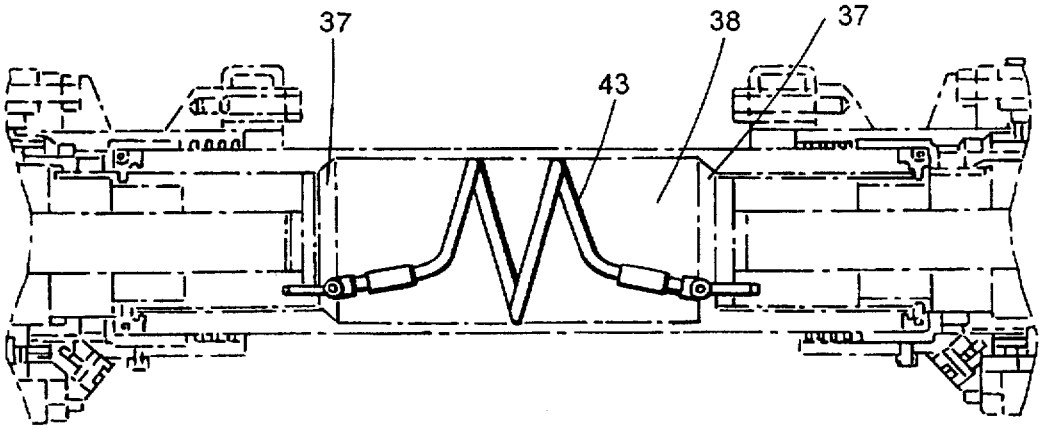

In the event that the device 3 for connecting between the rolling elements 2 (FIG. 1) is mounted on the axle assembly of the invention, electrical continuity between the wheels 17 will be guaranteed by means of braids 43 of superflexible cable (FIG. 12*b*) linked up to the bushes 37 keyed on to the ends of the semiaxles 18. The braids 43 are mounted in the hollow interior of the shaft 38 of the connecting device 3.

Figure 12C:
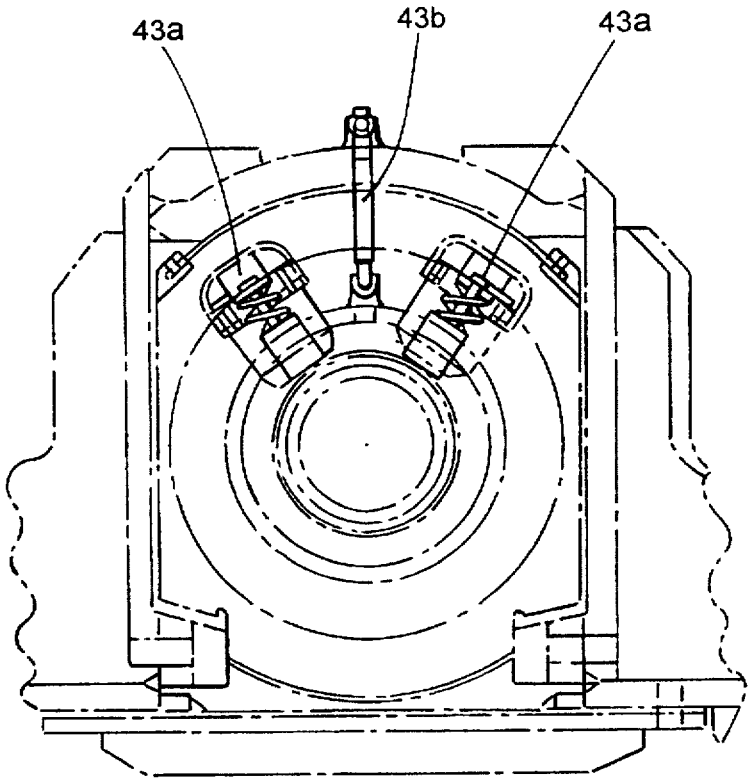
Figure 12D:
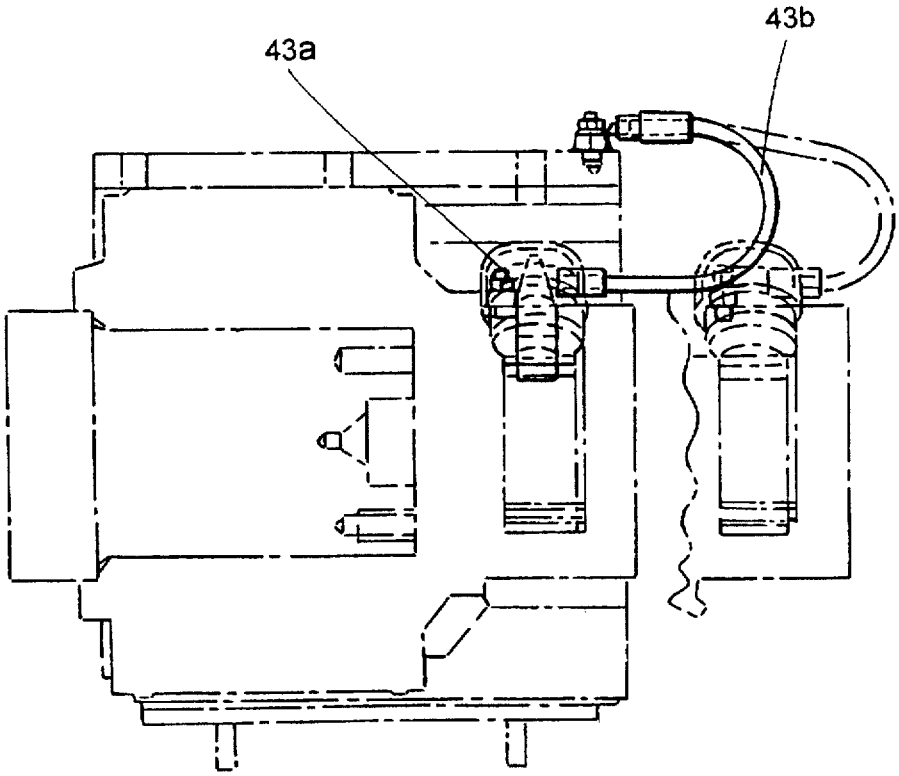

On the other hand, if no device 3 for connecting rolling elements 2 is mounted on the axle assembly of the invention, electrical continuity between wheels will be guaranteed by means of electrical shunting assemblies 5 (FIG. 1*a*) identical to those currently incorporated in TALGO rolling units. These assemblies, which are illustrated in detail in FIGS. 12*c* and 12*d* and which would be mounted on the outer covers of the outer bearings 19 of each rolling element assembly 2, have exhibited entirely satisfactory behavior throughout the years during which they have continued to be used. These shunting assemblies include collectors 43*a*, with their corresponding brushes, connected to the metal truss of the axle frame 1 by means of braids 43*b* of superflexible cable, the electrical circuit being closed through said truss.

The main advantages afforded by incorporating the axle assembly of the invention into conventional freight bogies are as follows:

- A track gauge change system and rolling element assemblies are used which are entirely analogous to those of the TALGO rolling units amply tried and tested in commercial service for the European network and for the two Spanish track gauges.
- Gauge change is completely automatic, both the position of the wheels and that of the brake shoes being modified.
- The thermal state of the outer bearings can be monitored fully guaranteed with the current detectors mounted in the track, both in wide gauge and in narrow gauge.
- The system incorporates a safety device for detecting possible heating of its inner bearings.
- It offers maximum safety against the unlocking of the rolling elements on account of foreign agents on the track (tools, large pieces which have fallen, mounds of ballast, etc.), since all the components of the system are protected by the sheet metal of the axle frame.
- The system will require a much shorter period and lower cost of implementation than any other solution.
- It will be possible to carry out change of gauge of the wagons furnished with the axle assembly of the invention in the existing fixed installations for TALGO passenger trains, which means that no new investment will be required in those locations in which, as in Spain, these installations already exist.
- The system can be incorporated into already manufactured bogies, exchanging their fixed-gauge axles for the new assemblies of the invention with gauge change.
- Finally, the system fulfils all the technical demands and all the operating and maintenance requirements fixed hitherto by UIC subcommittee 45/B/42 competent in this matter.

Figure 11A:
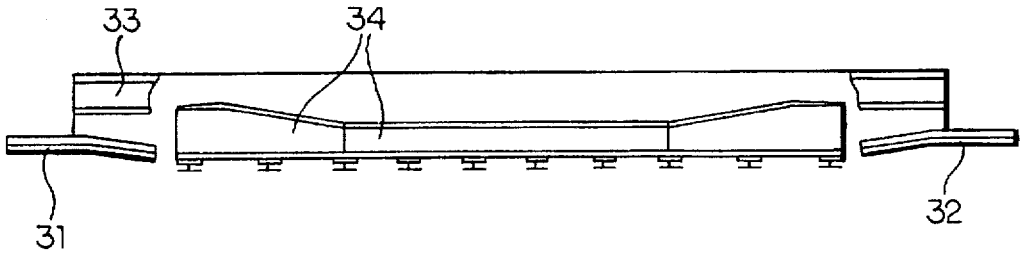

There is described below with reference to FIGS. 11 and 11*a* the process for changing track gauge on passing through a straightforward fixed installation devised for carrying out this changing, and which is of small dimensions and is situated at the transition station. Although this installation is devised in order to work with locking catches with a hollow bridge, it will be understood that with a slight change in the fashioning of the unlocking guides for said catches it would be possible to use said installation with rolling elements having catches with a solid bridge. The manner of operation of the installation would be the same in both cases. Therefore, the following description, in spite of referring to the case of hollow-bridge catches, is also valid for the case of solid-bridge catches.

The changing process is completely automatic, being effected when the wagons pass through the fixed installation at a speed no greater than 20 km/h.

Figure 11:
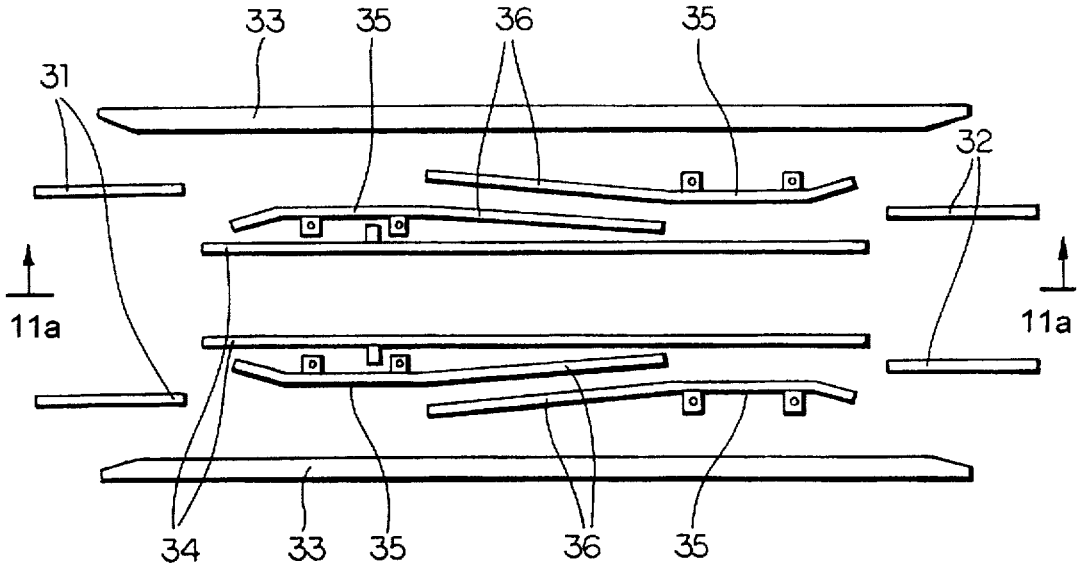

Represented schematically in FIG. 11 is the fixed installation for changing track gauge, the fundamental constituent components of which are as follows:

- End of the rails 31 of the track of greater gauge.
- End of the rails 32 of the track of lesser gauge.
- Guide rails for sliding and centering 33.
- Guides 34 for unlocking and locking the catches 28.
- Guides for translating the rolling element assemblies 2, including elastic regions 35 and rigid regions 36.

The fixed installation is two-way, the change from wide to narrow gauge being effected in one direction whilst the reverse change is accomplished in the opposite direction.

The track gauge change process for a wagon arriving at the installation via the wide gauge is performed as follows:

When the wheels 17 reach the descending region of the end of the rails 31 a gradual descent of the bogie begins, until the slider slippers 15 make contact with the slideway and centering guide rails 33. From this moment, the rolling elements 2 are unloaded, remaining thus throughout the change process, until contact is made with the rails 32 of lesser gauge at the finish thereof.

With each rolling element 2 being free of load, it descends slightly due to its weight until the surfaces 24 of the outer bearing 19 and 27*b* of the inner bearing 20 are supported by the lower abutment pieces 11 and 13*a* of their cradles 7 and 8, respectively. In this position, the elastic wedges 12*a* of the inner bearings 20 cease pressing on the lugs 27 and the latter against the shafts 28*a* of the catches 28, the latter being freed and disposed for unlocking thereof.

The slideway and centering guides 33 possess a system of lubrication using water, guaranteeing a low coefficient of friction when the slippers 15 and the guide plates 16 slide over them.

Once the axle assembly has been supported and centred on the guides 33, the head of the end of the unlocking guides 34 is inserted into the housing 28*b* of the catches 28. The first portion of this guide 34 possesses a downward profile which compels the catches 28 to descend, overcoming the force of their springs 29 and their retainers 30, until the lugs 27 of the inner bearings 20 are unlocked. From this point onwards, the profile of the unlocking guide 34 remains horizontal. At its other end, after the rolling elements 2 have passed into the narrow gauge position, the profile of said guide 34 turns upwards again, causing the locking of the catches 28 with the rolling elements 2 situated in the new track gauge.

When the process for unlocking the catches 28 is begun, the elastic part 35 of the guides for translating the rolling element assemblies 2 comes into contact with the inner face of the wheels 17, exerting an outwards pressure on them so as to promote the operation of descent of the catches 28. In the event of changing from narrow gauge to wide gauge, contact with the wheels 17 would be made from the outside and these would be pushed inwards.

Subsequently, with the catches 28 completely unlocked, the wheels 17 make contact with the rigid region 36 of the guides for translating the rolling element assemblies 2, displacing them to the narrow gauge position. The wheels 17 then make contact with the elastic region 35 of the opposite end of these guides, compelling them to remain in their inboard transverse abutment position (on passing from narrow gauge to wide gauge, they would remain in contact with their outer abutments), this facilitating the locking of the catches 28. With the wheels 17 being in this region, the guides 34 of the catches 28 compel the latter to rise and remain locked in their upper position.

Once the inner bearings 20 are locked, the catches 28 leave their locking guides 34 and the wheels 17 make contact with the upward region of the rails 32 of the narrow gauge, compelling the wheels 17 to rise slightly until the upper surfaces 21 and 25 of the outer and inner bearings 19 and 20, respectively, come into contact with their cradles 7 and 8, and compressing the lug 27 of the inner bearings 20 between the wedge 12*a* and the shafts 28*a* of the catches 28, the process of locking the rolling elements 2 having finished.

When the wheel 17 ascends via the end of the rails 32, the slippers 15 cease being supported on their slideway guides 33, concluding the gauge change operation.

The process for changing from narrow gauge to wide gauge is entirely analogous, and the approximate length of the fixed installation for changing track gauge is 12 m.

The applicant intends that the above description offer a detailed account of the essential characteristics of the invention. However, experts will appreciate that it will be possible to make modifications of detail to the axle assembly described without thereby departing from the field of the invention. Therefore, it is expected that the scope of the latter remain limited solely by the content of the appended claims.

What is claimed is:

1. Railway axle assembly having a track gauge change system adapted to be incorporated with a bogie in substitution for a fixed-gauge mounted axle, said axle assembly comprising two independent rolling element assemblies (2), each including a monobloc wheel (17) with a semiaxle (18) and two bearings, one bearing being an outer bearing (19) and the other bearing being an inner bearing (20), a locking system for locking the inner bearings (20) of the two rolling element assemblies (2) in two relative positions in which the wheels of the two assemblies (2) have two different transverse spacings corresponding to two different track gauges, said locking system comprising a locking catch (28) which includes two vertical shafts (28*a*; 28*a*') of rectangular section, connected together by a connecting bridge, said inner bearings including means for locking and unlocking said inner bearings and said locking catch, an axle frame (1) on which are mounted said two rolling element assemblies (2) and said locking system, two trusses (4) for translating brake shoes with the rolling element assemblies during change of transverse spacing for different track gauges, a system (5, 43) for providing electrical continuity between the wheels (17), of the two rolling element assemblies, and a device (6) for detecting when said inner bearings (20) become hot.

2. Axle assembly according to claim 1 wherein said axle frame (1) comprises of a metal truss which rigidly connects together four cradles (7, 8) for housing said inner and outer bearings (19, 20) of the two rolling element assemblies, springs supported on the metal truss for suspending the bogie by means of corresponding housings (9) on the truss, the cradles (7) for housing the outer bearings (19) engaging in the housings (9) on mounting the axle assembly on the bogie.

3. Axle assembly according to claim 2, wherein said cradles (7) for the outer bearings have outer vertical faces with slider plates (10) to facilitate the transverse displacement of the rolling element assemblies (2) during the track gauge change operation, said cradles (7) for the outer bearings having inner faces with inclined surfaces (11) which act as vertical abutments and on which the associated outer bearing (19) is supported and slid transversely during the track gauge change operation, said cradles (8) for the inner bearings having upper (12) and lower (13) abutment and guide pieces for the inner bearings (19) and the locking catch (28).

4. Axle assembly according to claim 1, wherein said axle frame (1) has outer arms with sliding slippers (15) and centering plates (16) from which the bogie is supported, slid and guided transversely over a slideway guide (33) of a fixed installation for track gauge change during the track gauge change operation, the slippers (15) having a baseplate (15*b*) and a knuckle joint (15*a*) which transmits load to said frame (1) and provides good contact with said slideway guide (33).

5. Axle assembly according to claim 4, wherein the baseplate (15*b*) of the slippers (15) and the centering plates (16) are made of plastic.

6. Axle assembly according to claim 1, wherein each said outer bearing (19) has inclined planes (24) machined in the lower part of two vertical plane faces (22) thereof, which planes act as vertical abutments and are supported on corresponding abutments (11) of the associated outer cradle (7) when the wheel (17) is unloaded in the track gauge change operations, said outer bearing (19) sliding over said planes on displacing the wheel (17), each said inner bearing (20) having a lug (27) machined on each of two vertical plane faces (26), for locking and transmission of transverse loads between the respective rolling element assembly (2) and the axle frame (1), said lug (27) fitting between and being compressed by upper abutment pieces (12) of the cradle (8) of the associated inner bearing (20) and the locking catch (28).

7. Axle assembly according to claim 6, wherein the cradle (8) of the inner bearing (20) includes four said upper abutment pieces (12), each of which has an elastic mounting wedge (12), a vertical surface (12*c*) for lateral abutment and another vertical surface (12*b*) for abutment and guidance of the locking catch (28), the lug (27) of the bearing (20) being heavily compressed along an inclined surface (27*a*) thereof by the wedge (12*a*) on the side containing said lug and the compressing force being transmitted to the locking catch (28) through a vertical face (27*c*) of said lug (27), said cradle (8) of the inner bearing including four said lower abutment pieces (13) each of which has an upper part with an inclined surface (13*a*) on which a lower face (27*b*), of corresponding inclined surface, of the lug (27) of the bearing (20) is supported and slid in the track gauge change operation, each of said abutment pieces 913) also having a vertical surface (13*b*) for guiding the locking catch (28).

8. Axle assembly according to claim 1, comprising a device (3) for connecting the rolling element assemblies (2) and including two steel bushes (37) each keyed on an inner end of the semiaxles (18) of the wheels (17) and each provided with an inner female fluted region of a length somewhat greater than half the difference between the transverse spacing of the two different track gauges, a shaft (38) mounted between the bushes (37) having opposite ends with heads (38*a*) having male flutings housed in the female fluted regions of the bushes (37), rubber abutments (41) lightly compressed against the ends of the semiaxles (18) in the narrow gauge position, an abutment hoop (40) installed in the end of each bush (37) which retains a rubber abutment (39) which is abutted and mildly compressed by the head (38*a*) of the shaft (38) in the wide gauge position and which also engages the shaft (38), thereby preventing entry of dust or water into the aforesaid flutes.

9. Axle assembly according to claim 1, comprising a device (3) for connecting the rolling element assemblies (2) and including two steel bushes (37) each keyed on an inner end of the semiaxles (18) of the wheels (17) and each provided with an inner female fluted region of a length somewhat greater than half the difference between the transverse spacing of the two different track gauges, a shaft (38) mounted between the bushes (37) having opposite ends with heads (38*a*) with male flutings housed in the female fluted regions of the bushes 37), rubber abutments (38*b*) which are lightly compressed against the ends of the semiaxles (18) in the narrow gauge position, an abutment hoop installed in the end of each bush (37) by another bush (40') threaded externally on the steel bush (37), the hoop (39') having a vulcanized rubber region which is mildly compressed by the head (38a) of the shaft (38) in the wide gauge position, the externally threaded bush (40') carrying retainer rings (42, 43) for engaging the shaft (38) to prevent entry of dust or water into the aforesaid flutes of the bushes.

10. Axle assembly according to claim 1, wherein said two trusses (4) for translating the brake shoes each comprises two arms (4a) connected together by a bridge (4b) which connects to an outer cover of the inner bearing (20), a fork (4c) being arranged at an end of each of said arms (4a) said fork (4c) having sliding inner plates which clasp a corresponding brake shoe support therebetween, so that, on displacing the rolling element assemblies (2), together with the trusses (4), in the track gauge change operation, the brake shoes are displaced to a position corresponding to the new track gauge.

11. Axle assembly according to claim 8, wherein said system for providing electrical continuity between the wheels (17) comprises braids (43) of superflexible cable which are connected to the steel bushes (37) keyed to the ends of the semiaxles (18) and which are housed in a hollow interior of the shaft (38) of the device (3) for connecting the rolling element assemblies (2).

12. Axle assembly according to claim 1, wherein the system for providing electrical continuity between the wheels (17) comprises electrical shunting assemblies (5) mounted in outer covers of the outer bearings (19) and which include collectors (43a), with corresponding brushes, connected to a metal truss of the axle frame (1) by braids (43b) of superflexible cable.

13. Axle assembly according to claim 1, wherein the device (6) for detecting when the inner bearings (20) become hot comprises a mechanical-type detector which comprises an expansion thermostat (44) housed in the end of the semiaxle (18) proximate the inner bearing (20), said thermostat having a displaceable heat-sensitive button, a rod (44b) housed in an interior of the semiaxle (18), said rod (44b) having one end almost in contact with the button of the thermostat (44) and which is maintained in an inactive position by a spring mounting (45), the rod (44b) carrying at its other end a friction disc (44a) positioned to rub against an outer cover of the outer bearing (19) when the maximum allowable temperature is reached in the region of the inner bearing (20) and the button of the thermostat (44) is displaced outwards and displaces the rod (44b), so that said cover of the outer bearing (19) heats up and for detection by detectors installed on the track.

14. Axle assembly according to claim 1, wherein the device (6) for detecting when the inner bearings (20) become hot comprises a pneumatic detector which comprises a thermostat (46) mounted in an outer cover of each inner bearing (20) to detect the temperature thereat and when the inner bearing reaches a maximum allowable temperature, said thermostat actuates a pneumatic valve (47) which releases control pressure in an emergency valve (49) which opens and causes discharging of pressure in a main brake pipe (50) and reduction of maximum braking, said device (6) further comprising a stopcock (51) for restoring the braking after actuation of the emergency valve (49).

15. Axle assembly according to claim 1, comprising a locking catch (28) including vertical shafts (28a') connected together by a transverse connecting bridge (28b'), said bridge (28b') being solid and wider than a base of said shafts (28a') to cooperate with a fixed installation for changing track gauge having an unlocking guide (34) with a head (34a) having a hollow profile adapted to receive said bridge (28b'), said bridge having a cross-section of rectangular form having upper and lower faces covered with plastic (28c'), a platen welded to each shaft (28'), said platen (28d') being displaceable upwards and downwards through a slot provided in the upper part of the cradle (8) housing the inner bearing (20) of the rolling element assemblies (2), said platen (28d') being connected, at an upper end, to helical springs (29') which urge the catch (28) to the locked position.

16. A railway axle assembly having an automatic track gauge change system adapted for mounting on a bogie and adaptable to a narrow gauge track and a wide gauge track, said railway axle assembly comprising:

two independent rolling element assemblies each including a semiaxle with a wheel fixed thereon, and inner and outer bearings on opposite sides of said wheel, an axle frame for supporting said two rolling element assemblies, said axle frame including a plurality of cradles supporting respective bearings of said two rolling element assemblies for relative displacement between a first position in which the rolling element assemblies are spaced from one another so that said wheels have a spacing corresponding to the wide gauge track and a second position in which said wheels have a spacing corresponding to the narrow gauge track, a locking system for locking said rolling element assemblies in said first and second positions, said locking system including a locking catch comprising vertical shafts for lockably and releasably engaging the inner bearings of the semiaxles and the cradles supporting said inner bearings, said inner bearings and their supporting cradles including guiding and abutment means which engage said shafts of the locking catch to establish the spacing of the wheels in said narrow and wide gauge tracks respectively, said axle frame being connected to said bogie and during change from one gauge track to another, said axle frame is lifted to raise the wheels from the track and release said locking system to enable the rolling element assemblies to be transversely displaced relative to the track between said first and second positions, said semiaxles being automatically displaced while said shafts of the locking catch and said guiding and abutment means are released when the axle frame is lifted so that the rolling element assemblies are moved between said first and second positions.

17. A railway axle assembly according to claim 16, further comprising:

means for translating brake shoes with the rolling element assemblies during movement thereof between said first and second positions, means for providing electrical continuity between the wheels of the two rolling element assemblies in the narrow and wide track positions, and means for detecting heating of the inner bearings of said rolling element assemblies.

18. A railway axle assembly according to claim 17 comprising means for connecting opposed inner ends of said semiaxles in the narrow and wide track positions.

* * * * *